US011069516B2

(12) United States Patent
Baba et al.

(10) Patent No.: US 11,069,516 B2
(45) Date of Patent: Jul. 20, 2021

(54) ELECTRO STATIC LINEAR ION TRAP MASS SPECTROMETER

(71) Applicant: DH TECHNOLOGIES DEVELOPMENT PTE. LTD., Singapore (SG)

(72) Inventors: Takashi Baba, Richmond Hill (CA); Eric Thomas Dziekonski, Richmond Hill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 16/646,672

(22) PCT Filed: Sep. 13, 2018

(86) PCT No.: PCT/IB2018/057017

§ 371 (c)(1),
(2) Date: Mar. 12, 2020

(87) PCT Pub. No.: WO2019/058226

PCT Pub. Date: Mar. 28, 2019

(65) Prior Publication Data

US 2020/0411299 A1 Dec. 31, 2020

Related U.S. Application Data

(60) Provisional application No. 62/562,597, filed on Sep. 25, 2017.

(51) Int. Cl.
*H01J 49/00* (2006.01)
*H01J 49/42* (2006.01)
(Continued)

(52) U.S. Cl.
CPC ..... *H01J 49/0031* (2013.01); *H01J 49/027* (2013.01); *H01J 49/065* (2013.01); *H01J 49/406* (2013.01); *H01J 49/4245* (2013.01)

(58) Field of Classification Search
CPC .... H01J 49/0031; H01J 49/027; H01J 49/065; H01J 49/406; H01J 49/4245
(Continued)

(56) References Cited

U.S. PATENT DOCUMENTS 5,880,466 A 3/1999 Benner
2011/0240845 A1 10/2011 Li
(Continued)

FOREIGN PATENT DOCUMENTS

JP 2015-072902 A 4/2015

OTHER PUBLICATIONS

International Search Report and Written Opinion for PCT/IB2018/057017, dated Jan. 2, 2019.

*Primary Examiner* — Kiet T Nguyen
(74) *Attorney, Agent, or Firm* — John R. Kasha; Kelly L. Kasha; Kasha Law LLC

(57) ABSTRACT

One or more ions are received along a central axis through a first set of reflectron plates of an ELIT. Voltages are applied to the first set of plates and to a second set of reflectron plates in order to trap and oscillate the one or more ions. A first induced current is measured from a cylindrical pickup electrode between the first set of reflectron plates and the second set of reflectron plates. A second induced current is measured from one or more plates of the first set of reflectron plates. A third induced current is measured from one or more plates of the second set of reflectron plates. The first measured induced current, second measured induced current and third measured induced current are combined to reduce higher order frequency harmonics of the induced current.

17 Claims, 31 Drawing Sheets

(51) Int. Cl.
*H01J 49/06* (2006.01)
*H01J 49/40* (2006.01)
*H01J 49/02* (2006.01)

(58) Field of Classification Search
USPC ..... 250/290, 281, 282
See application file for complete search history.

(56) References Cited

U.S. PATENT DOCUMENTS

| | | | | |
|---|---|---|---|---|
| 2012/0112056 | A1* | 5/2012 | Brucker ..... | H01J 49/4245<br>250/282 |
| 2013/0068942 | A1 | 3/2013 | Verenchikov | |
| 2013/0313425 | A1 | 11/2013 | Verenchikov | |
| 2014/0264068 | A1* | 9/2014 | Brucker ..... | H01J 49/0009<br>250/423 R |

* cited by examiner

100

200

300

500

(PRIOR ART)

600

700

800

900

1000

1100

1300

1600

1700

1800

1900

2000

2100

2200

2300

2400

2500

2700

2900

3000

3100

ELECTRO STATIC LINEAR ION TRAP MASS SPECTROMETER

RELATED APPLICATIONS

The present application claims the benefit of U.S. Patent Application No. 62/562,597, filed on Sep. 25, 2017, the entire contents of which are incorporated herein by reference.

INTRODUCTION

The teachings herein relate to an electrostatic linear ion trap mass spectrometer (ELIT-MS). More particularly the teachings herein relate to systems and methods for reducing higher-order harmonics in an electrostatic linear ion trap (ELIT). The systems and methods disclosed herein include new methods of measuring the induced current from an ELIT and new configurations of an ELIT.

ELIT-MS

An ELIT-MS is a type of mass spectrometer that achieves a high mass resolution. An ELIT-MS includes an ELIT for performing mass analysis of ions. In an ELIT, electric current induced by oscillating ions in the trap is detected. The measured frequency of oscillation of the ions is used to calculate the mass-to-charge ratio (m/z) of the ions. For example, a Fourier transform is applied to the measured induced current.

Dziekonski et al., Int. J. Mass Spectrom. 410 (2016) p 12-21, (the "Dziekonski Paper") describes an exemplary ELIT. The Dziekonski Paper is incorporated by reference herein.

FIG. 1 is a three-dimensional cutaway side view of an exemplary conventional ELIT 100. ELIT 100 is similar to the ELIT of the Dziekonski Paper. ELIT 100 includes first set of reflectron plates 110, pickup electrode 115, and second set of reflectron plates 120. First set of reflectron plates 110 and second set of reflectron plates 120 include plate electrodes with holes in the center. Note that the end electrodes of first set of reflectron plates 110 and second set of reflectron plates 120 do not include holes in the center. However, this is only for simulation purposes. In an actual device, these end electrodes can include holes in the center for the introduction and/or removal of ions from ELIT 100.

In ELIT 100, ions are introduced axially and oscillate axially between first set of reflectron plates 110 and second set of reflectron plates 120. Pickup electrode 115 is used to measure the induced current produced by the oscillating ions. A Fourier transform is applied to the induced current signal measured from pickup electrode 115 to obtain the oscillation frequency. From the oscillation frequency or frequencies, the m/z of one or more ions can be calculated.

FIG. 2 is an exemplary plot 200 showing how ion energy and oscillation frequency are related in an ELIT. An ion is trapped in an ELIT by the voltages applied to the reflectron plates and the electric field they produce. The relative trapped kinetic energy of the ion is set by the voltage difference between the injection device and the field free region of the ELIT.

FIG. 3 is an exemplary plot 300 of the electric field produced in a conventional ELIT by the voltages applied to the reflectron plates. Reflectron plates 311, 312, 313, 314, 315, 316, 317, 318, and 319 are biased with voltages of 0, 200, 400, 600, 800, 1000, 1200, 1400, and 1600 V, respectively. Similarly, reflectron plates 321, 322, 323, 324, 325, 326, 327, 328, and 329 are biased with voltages of 0, 200, 400, 600, 800, 1000, 1200, 1400, and 1600 V, respectively.

Note that depending on the charge of the ions the reflectron plates can be biased negatively or positively.

The voltages applied to the reflectron plates at either end of the ELIT produce an electric field 330. Electric field 330 can be expressed as $E=4K/eL$, where K is the kinetic energy of ions (ZeV), L is length 340, and e is a single proton charge of $1.602\times10^{-19}$. It should be specified that this assumes a perfectly linear electric field in the reflectrons as is shown in FIG. 4. Electric field 330 is measured in V/m. Length 340 is typically on the order of 44 mm, for example. Electric field 330 causes ions to oscillate axially along path 350 between the reflectron plates at either end of the ELIT. Essentially, the voltages applied to the reflectron plates at either end of the ELIT produce a potential well for ions.

FIG. 4 is an exemplary diagram 400 of the potential well produced by voltages applied to the reflectron plates at either end of an ELIT. Path 450 depicts the voltages experienced by ions in potential well 410.

Ideally, the trajectory of ions in an ELIT can be expressed as a semi-sinusoidal waveform where the frequency, f, is equal to $\sqrt{K/8mL^2}$, when the electric field in the reflectrons is linear and follows $E=4K/eL$.

FIG. 7 is an exemplary annotated plot of the semi-sinusoidal trajectory of an ion in an ELIT, in accordance with various embodiments. Semi-sinusoidal trajectory 701 shows the position of an ion with respect to time.

The sinusoidal trajectory of an ion in an ELIT is detected by measuring the induced current on a pickup electrode, such as pickup electrode 115 of FIG. 1. Unfortunately, however, the induced current in a conventional ELIT is not a sinusoid. The frequency, f, of the induced current in a conventional ELIT is, for example, $\sqrt{K/2mL^2}$, when using a single detector, positioned at the center and when the electric field in the reflectrons is linear and follows $E=4K/eL$.

FIG. 5 is an exemplary plot 500 showing the induced current for an ion in a conventional ELIT. Plot 500 shows that induced current 510 for an ion is not a perfect sinusoid. Because induced current 510 is not a perfect sinusoid, when a Fourier transform is applied to induced current 510, not just one frequency is obtained. In other words, the Fourier transform of induced current 510 produces a fundamental frequency and higher order harmonics.

FIG. 6 is an exemplary plot 600 showing the fundamental frequency and higher order harmonics obtained by applying a Fourier transform to the induced current for an ion in a conventional ELIT. In plot 600, fundamental frequency 610 is calculated for the ion of FIG. 5. However, higher order frequencies or harmonics 620 are also found. In addition, some of the higher order frequencies are found with higher amplitudes than fundamental frequency 610.

As described above, the frequencies calculated from the induced current in an ELIT are used to determine the m/z values of ions. For example, the m/z value of an ion is calculated from the oscillation frequency, f, of an ion in an ELIT according to $m/z=eV/2f^2L^2$, under the assumptions of the previous equations. As a result, higher order frequencies can be misidentified as fundamental frequencies and, in turn, incorrect m/z values. Also, higher order frequencies of one ion can interfere with fundamental frequencies of other ions confounding the identification of the correct m/z values of those ions.

Consequently, there is a need for improved ELIT systems and methods that can reduce the higher order harmonics obtained from an ELIT.

SUMMARY

An electrostatic linear ion trap (ELIT) for measuring induced current of one or more ions and reducing higher order frequency harmonics of the induced current by combining the induced current with measurements from reflecting reflectron plates is disclosed. A method for measuring induced current of one or more ions and reducing higher order frequency harmonics of the induced current by combining the induced current with measurements from reflecting reflectron plates in an ELIT is also disclosed.

The ELIT includes a first set of reflectron plates, a cylindrical pickup electrode, a second set of reflectron plates, a voltage power supply, and measurement circuitry. The plates of the first set of reflectron plates each includes holes in the center and are coaxially aligned along a central axis. The first set of plates includes a first inlet plate followed by a first plurality of reflection plates followed by a first plurality of trapping plates.

The cylindrical pickup electrode is positioned so that a first end of the pickup electrode is adjacent to the first inlet plate of the first set of plates. The pickup electrode is coaxially aligned with the first set of plates along the central axis.

The plates of the second set of reflectron plates also each includes holes in the center and are coaxially aligned along the central axis. The second set of plates includes a second inlet plate followed by a second plurality of reflection plates followed by a second plurality of trapping plates. The second set of plates is positioned so that the second inlet plate is adjacent to a second end of the cylindrical pickup electrode.

The voltage power supply applies separate voltages to one or more plates of the first set of plates and to one or more plates of the second set of plates. These voltages are applied in order to trap and then oscillate one or more ions between the first set of plates and the second set of plates. The one or more ions have been received along the central axis through the holes of the first set of plates, for example.

The measurement circuitry is used to measure a first induced current from the cylindrical pickup electrode, a second induced current from one or more plates of the first set of reflectron plates, and a third induced current from one or more plates of the second set of reflectron plates. The measurement circuitry combines the first measured induced current with the second measured induced current and the third measured induced current to determine an induced current of the one or more ions. The use of the second measured induced current and the third measured induced current in addition to the first measured induced current reduces higher order frequency harmonics of the induced current.

In various embodiments, the one or more plates of first set of reflectron plates include the first inlet plate and one or more plates of the first plurality of reflection plates, and the one or more plates of second set of reflectron plates include the second inlet plate and one or more plates of the second plurality of reflection plates. The first measured induced current is combined with the second measured induced current and the third measured induced current by summing the second measured induced current, the third measured induced current, and twice the first measured induced current.

In various embodiments, the one or more plates of first set of reflectron plates include one or more plates of the first plurality of trapping plates and the one or more plates of second set of reflectron plates include one or more plates of the second plurality of trapping plates. The first measured induced current is combined with the second measured induced current and the third measured induced current by subtracting the second measured induced current and the third measured induced current from the first measured induced current.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
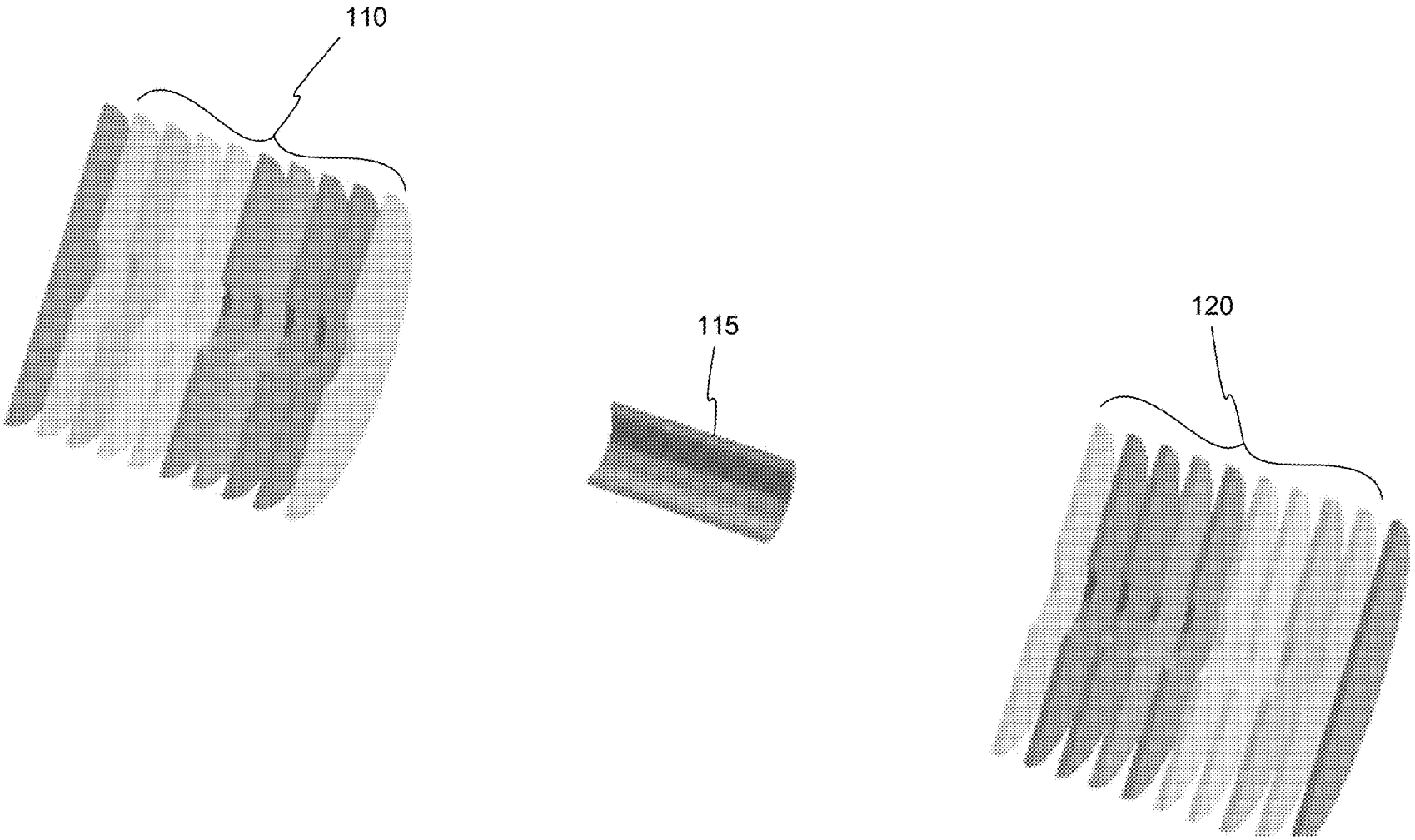
(PRIOR ART) FIG. 1
FIG. 1 is a three-dimensional cutaway side view of an exemplary conventional electrostatic linear ion trap (ELIT).
Figure 2:
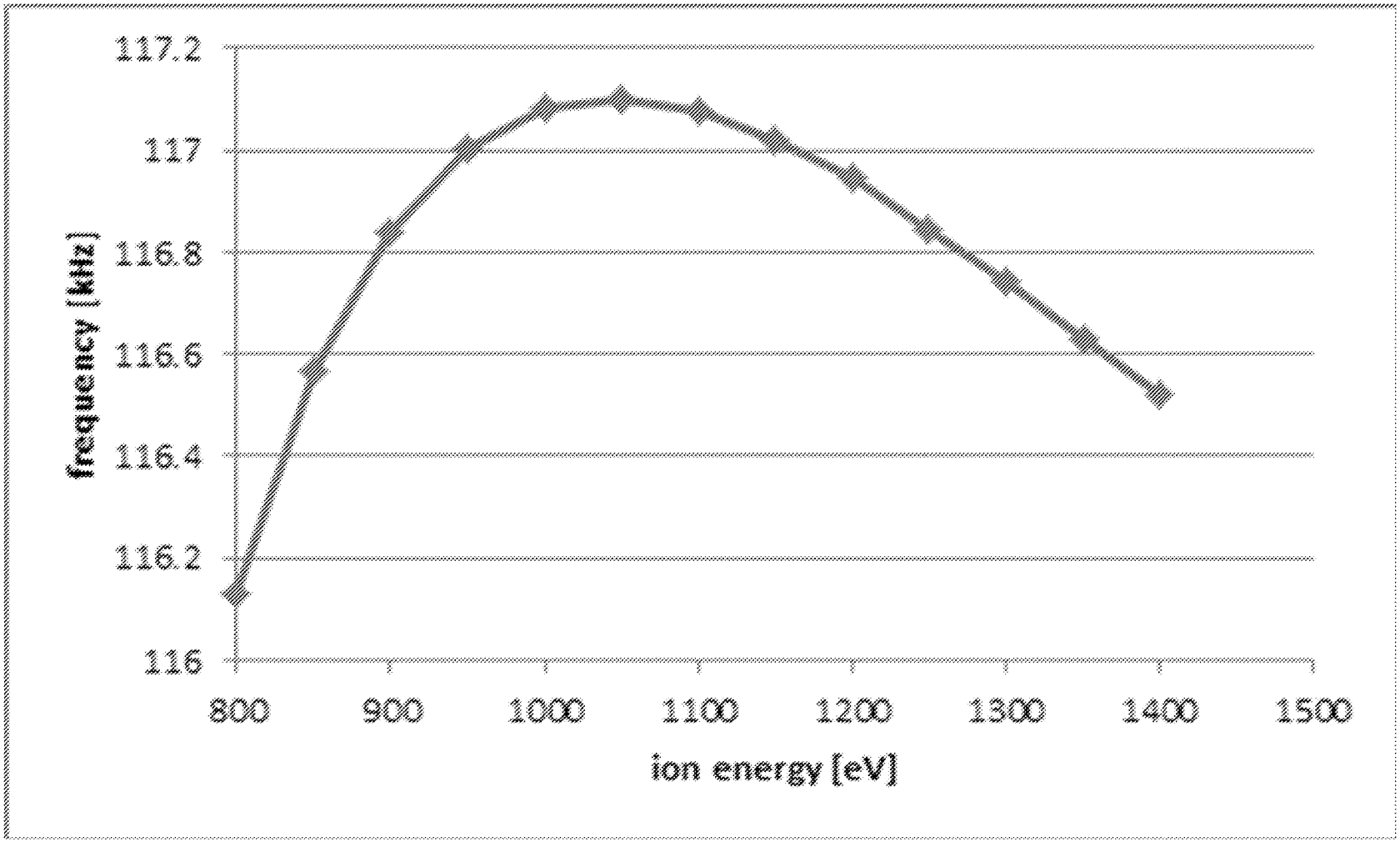
(PRIOR ART) FIG. 2
FIG. 2 is an exemplary plot showing how ion energy and oscillation frequency are related in an ELIT.
Figure 3:
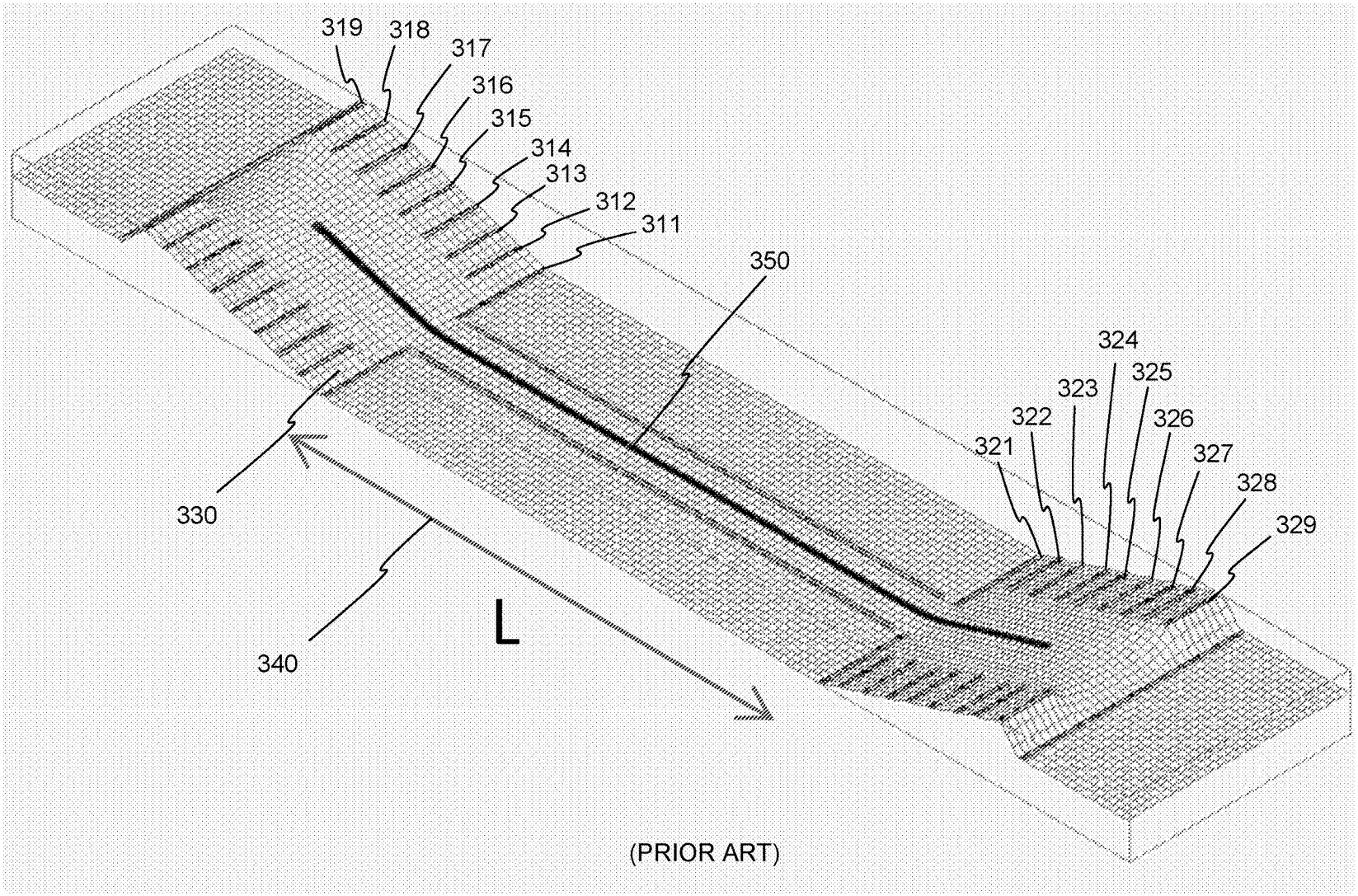
FIG. 3 is an exemplary plot of the electric field produced in a conventional ELIT by the voltages applied to the reflectron plates.
Figure 4:
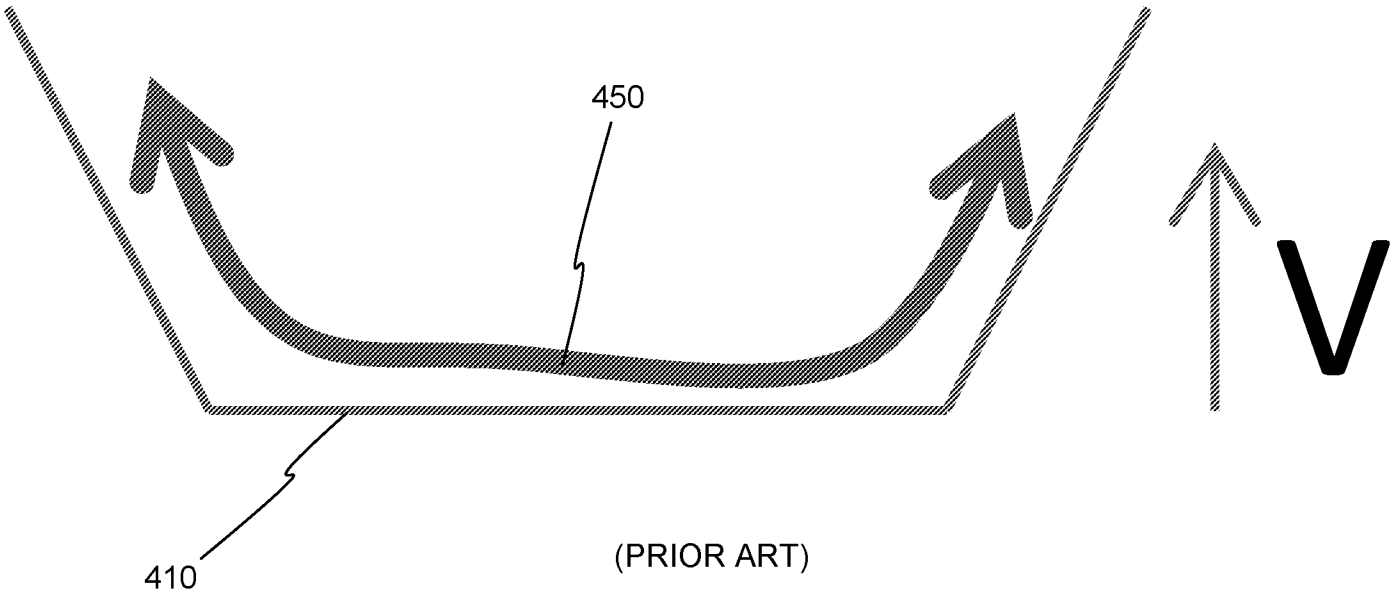
(PRIOR ART) FIG. 4
FIG. 4 is an exemplary diagram of the potential well produced by voltages applied to the reflectron plates at either end of an ELIT.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Systems and Methods for Reducing Harmonics in an ELIT

As described above, in an ELIT, ions are introduced axially and oscillate axially between a first set of reflectron plates and a second set of reflectron plates. A pickup electrode is used to measure the induced current produced by the oscillating ions. A Fourier transform is then applied to the induced current signal measured from the pickup electrode to obtain the oscillation frequency. From the oscillation frequency or frequencies, the mass-to-charge ratio (m/z) of one or more ions can be calculated.

Unfortunately, however, the induced current measured for each ion is typically not a perfect sinusoid. As a result, higher order harmonics or frequencies are found for each ion. These higher-order harmonics can result in the misidentification of the m/z value for an ion. Also, higher order harmonics or frequencies of one ion can interfere with fundamental frequencies of other ions confounding the identification of the correct m/z values of those ions.

Consequently, there is a need for improved ELIT systems and methods that can reduce the higher order harmonics obtained from an ELIT.

In various embodiments, higher order harmonics are reduced by measuring the induced current on the reflectron plates as well as on the pickup electrode and summing these induced currents. It is theorized that the short pickup electrode at the center of a conventional ELIT, such as the one shown in FIG. 1, does not adequately measure the induced current for the entire trajectory of an ion resulting in a non-sinusoidal measured induced current. More specifically, the short pickup electrode at the center of the ELIT does not adequately measure induced current when an ion is close to or inside the reflectron plates.

Figure 7:
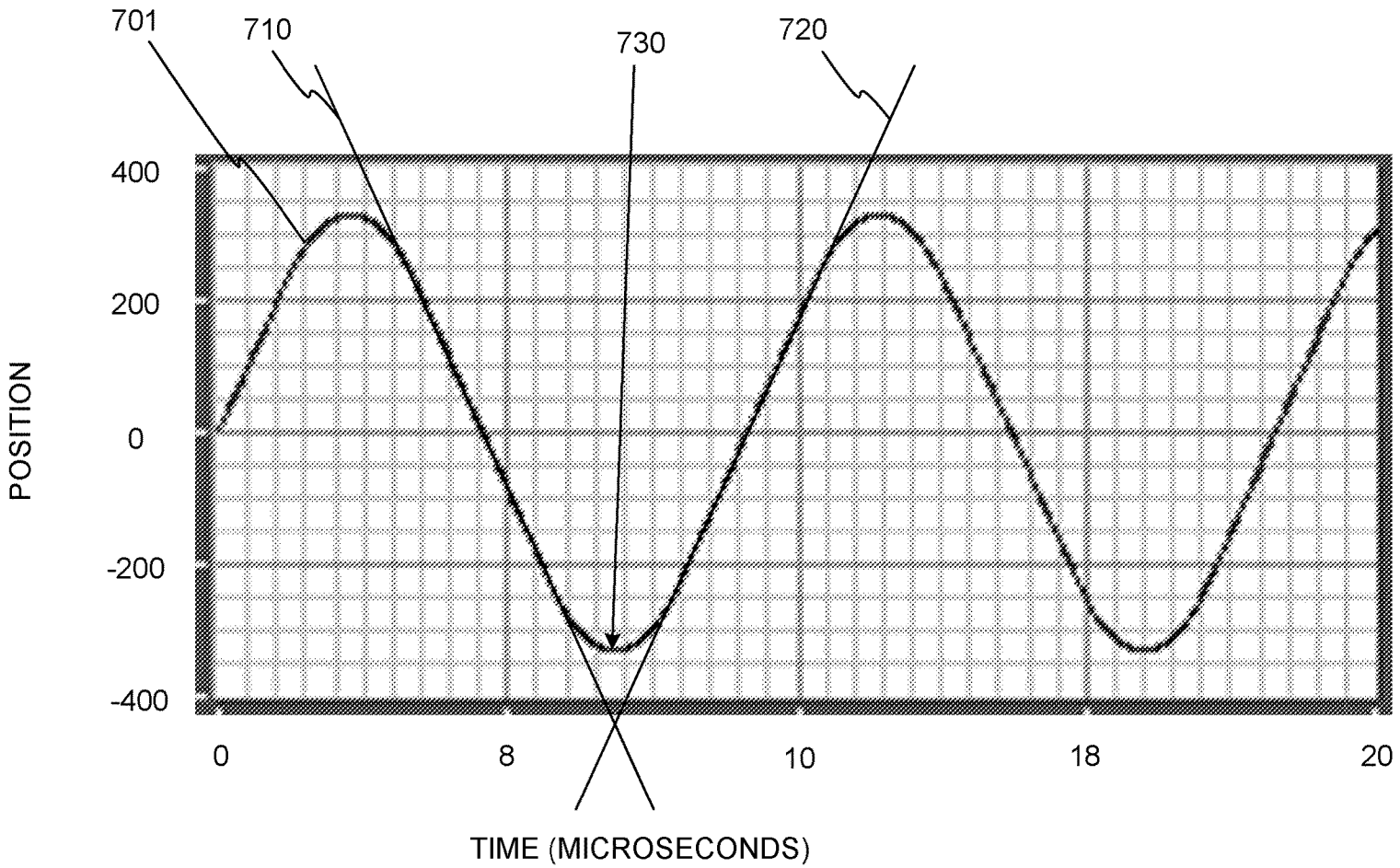
FIG. 7 is an exemplary annotated plot of the semi-sinusoidal trajectory of an ion in an ELIT, in accordance with various embodiments.

FIG. 7 is an exemplary annotated plot 700 of the semi-sinusoidal trajectory of an ion in an ELIT, in accordance with various embodiments. Semi-sinusoidal trajectory 701 shows the position of an ion with respect to time. Straight lines 710 and 720 delimit portions of semi-sinusoidal trajectory 701 where the ion is between the reflectron plates. The location between the reflectron plates in an ELIT can also be referred to as the field free region. So, straight lines 710 and 720 also delimit regions of semi-sinusoidal trajectory 701 where the ion is in the field free region.

Arrow 730 points to a parabola of semi-sinusoidal trajectory 701. The parabolas of semi-sinusoidal trajectory 701 represent the trajectory of the ion when the ion is within the reflectron plates of the ELIT.

Figure 8:
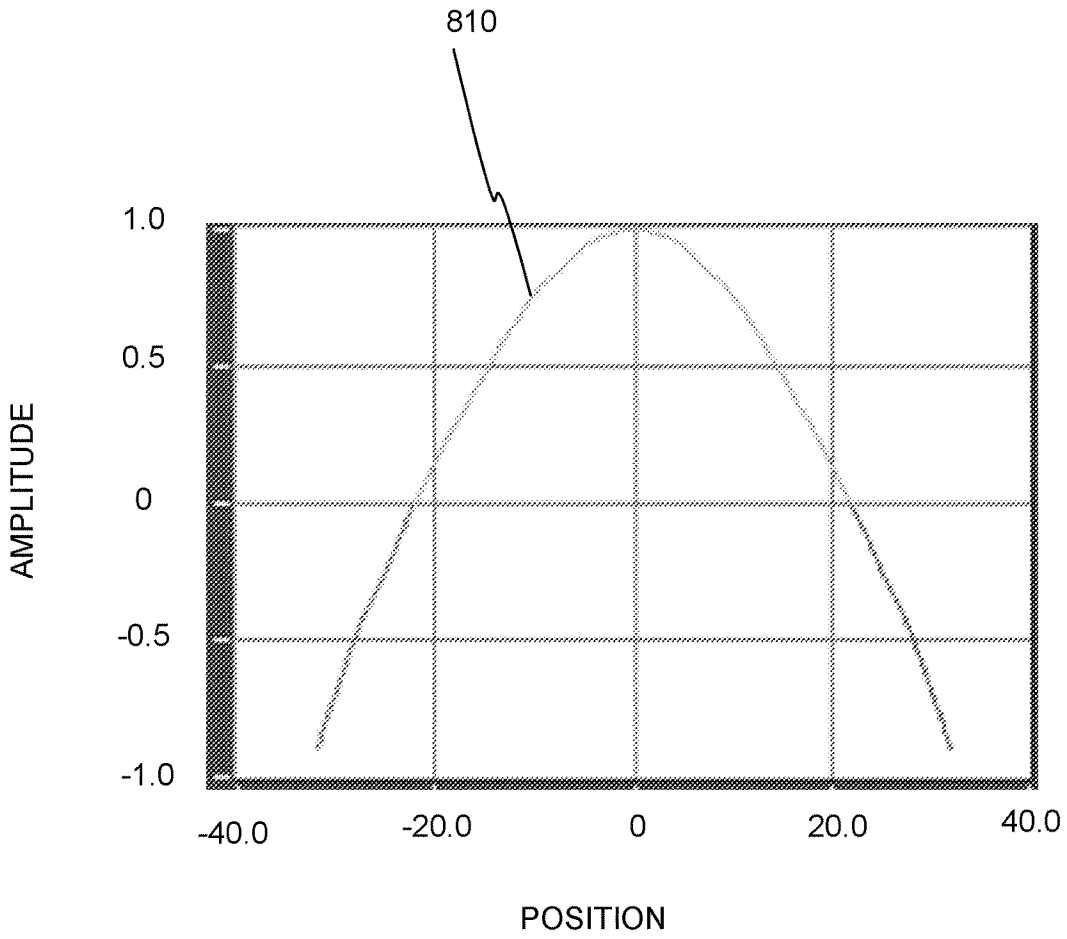
FIG. 8 is an exemplary plot of the amplitude of the induced charge versus position measured at an ideal pickup electrode of a theoretical ELIT that provides the semi-sinusoidal ion trajectory, in accordance with various embodiments.

FIG. 8 is an exemplary plot 800 of the amplitude of the induced charge versus position measured at an ideal pickup electrode of a theoretical ELIT that provides the semi-sinusoidal ion trajectory, in accordance with various embodiments. Plot 800 shows, for an ideal pickup electrode, intensity of induced charge 810 to obtain perfect sinusoidal induced current. In the field free region, the intensity of induced charge 810 has the form, $$\cos\left(\frac{\pi}{2}\frac{x}{X_0}\right),$$

where x is the position (parameter) from the center of the field free region, and $X_0$: position of the inlet plates of the reflectors (311 and 321) from the field free region. In the reflectors, the intensity of induced charge 810 has the form, $$-\cos\left(\frac{\pi}{2}\sqrt{\frac{X_{max}-x}{X_{max}-X_0}}\right).$$

here $X_{max}$ is the position that the ions can be reached (or maximum distance) from the center of the field free region. In the case of an example, $X_0$ is 22.0 mm, a half of the length of the field free region, L=44 mm. Note that when the ion is between −22.0 and +22.0, the amplitude is positive. This is when the ion is between the reflectron plates or in the field free region. When the position of the ion is less than −22.0 or greater than +22.0, the ion is within one of the two sets of reflectron plates and the amplitude is negative. The ideal pick up profile 810 gives perfect sinusoidal induced charge when an ion is traveling the ideal ELIT electrode that produced semi-sinusoidal trajectory in FIG. 7. The induced current is also perfect sinusoidal because the induced current is equivalent to the differentiated induced charge by time.

Figure 9:
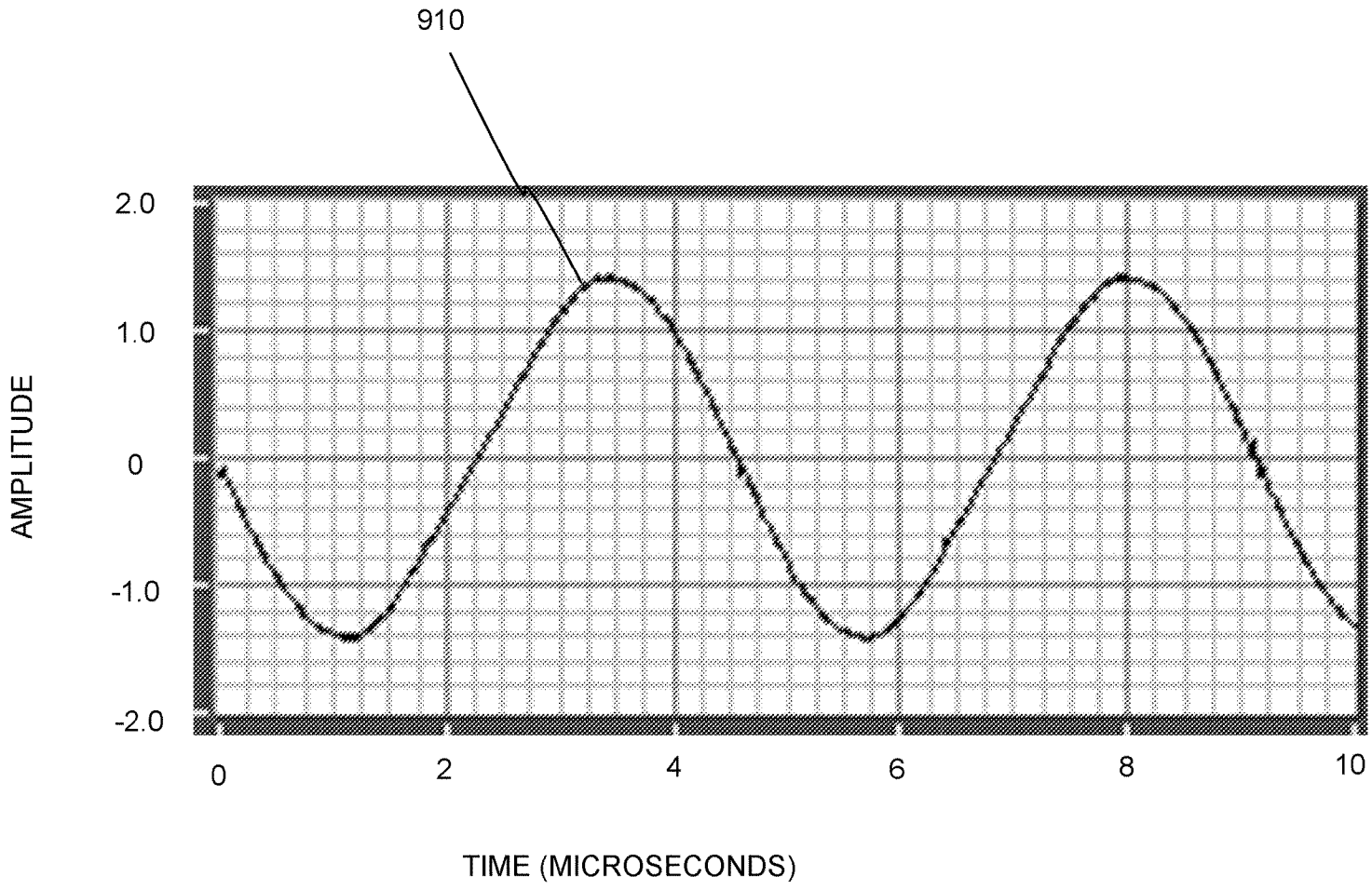
FIG. 9 is an exemplary plot of the amplitude of the induced current versus time measured at an ideal pickup electrode of a theoretical ELIT, in accordance with various embodiments.

FIG. 9 is an exemplary plot 900 of the amplitude of the induced charge versus time measured at an ideal pickup electrode of a theoretical ELIT, in accordance with various embodiments. Plot 900 shows that an ideal pickup electrode can produce a measured induced current 910 that is almost a perfect or ideal sinusoid. Plot 900 can be compared to plot 500 of FIG. 5, which shows a non-ideal sinusoid produced by a conventional pickup electrode.

Figure 10:
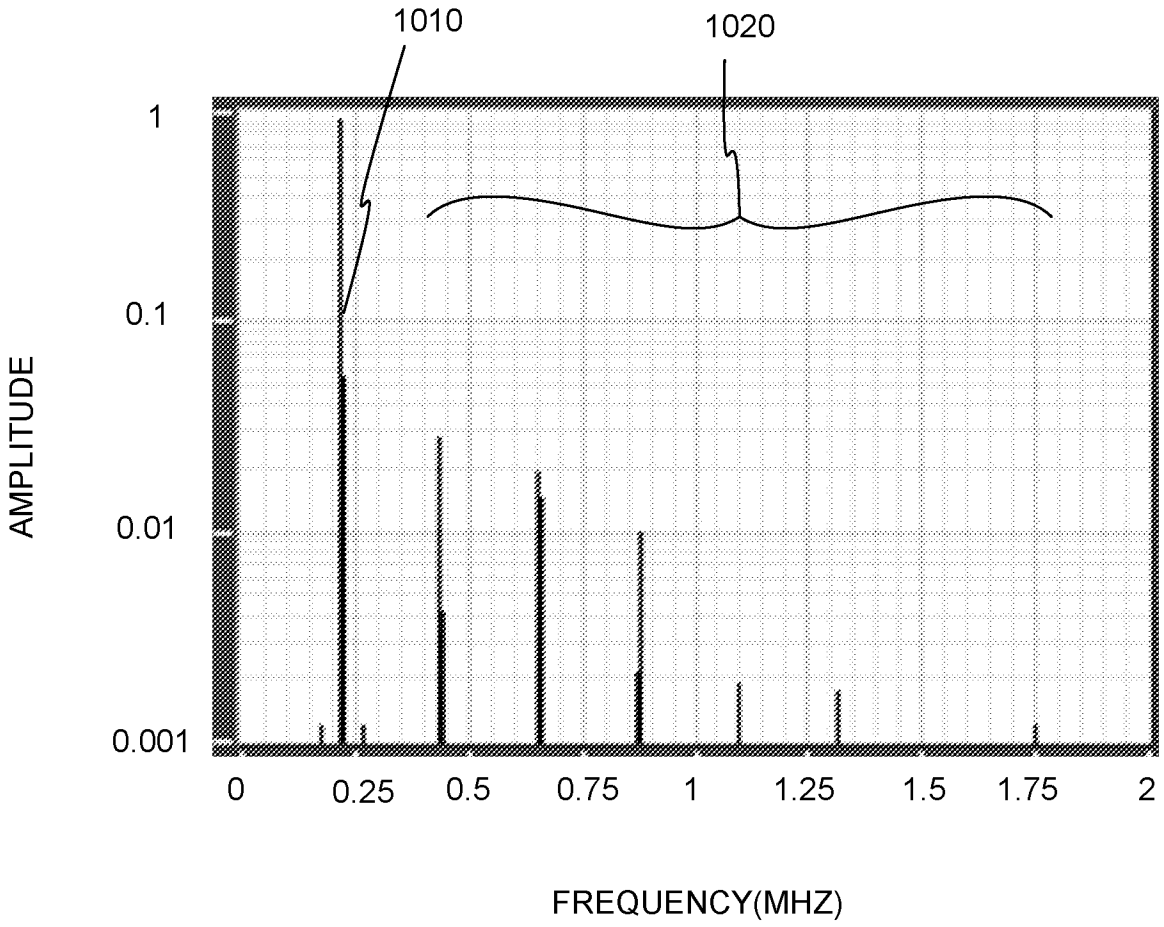
FIG. 10 is an exemplary plot showing the fundamental frequency and higher order harmonics obtained by applying a Fourier transform to the measured induced current for an ion in a theoretical ELIT that includes an ideal pickup electrode, in accordance with various embodiments.

Performing a Fourier transform on the almost perfect or ideal sinusoidal, such as measured induced current 910, greatly reduces higher order harmonics. FIG. 10 is an exemplary plot 1000 showing the fundamental frequency and higher order harmonics obtained by applying a Fourier transform to the measured induced current for an ion in a theoretical ELIT that includes an ideal pickup electrode, in accordance with various embodiments. In plot 1000, fundamental frequency 1010 is calculated for the ion of FIG. 9. Higher order frequencies or harmonics 1020 are also found. However, higher order harmonics 1020 have a much smaller amplitude than fundamental frequency 1010. In other words, by using an ideal pickup electrode, the higher order harmonics can be significantly reduced. Plot 1000 can be compared to plot 600 of FIG. 6 to see how an ideal pickup electrode can reduce higher order harmonics.

Figure 11:
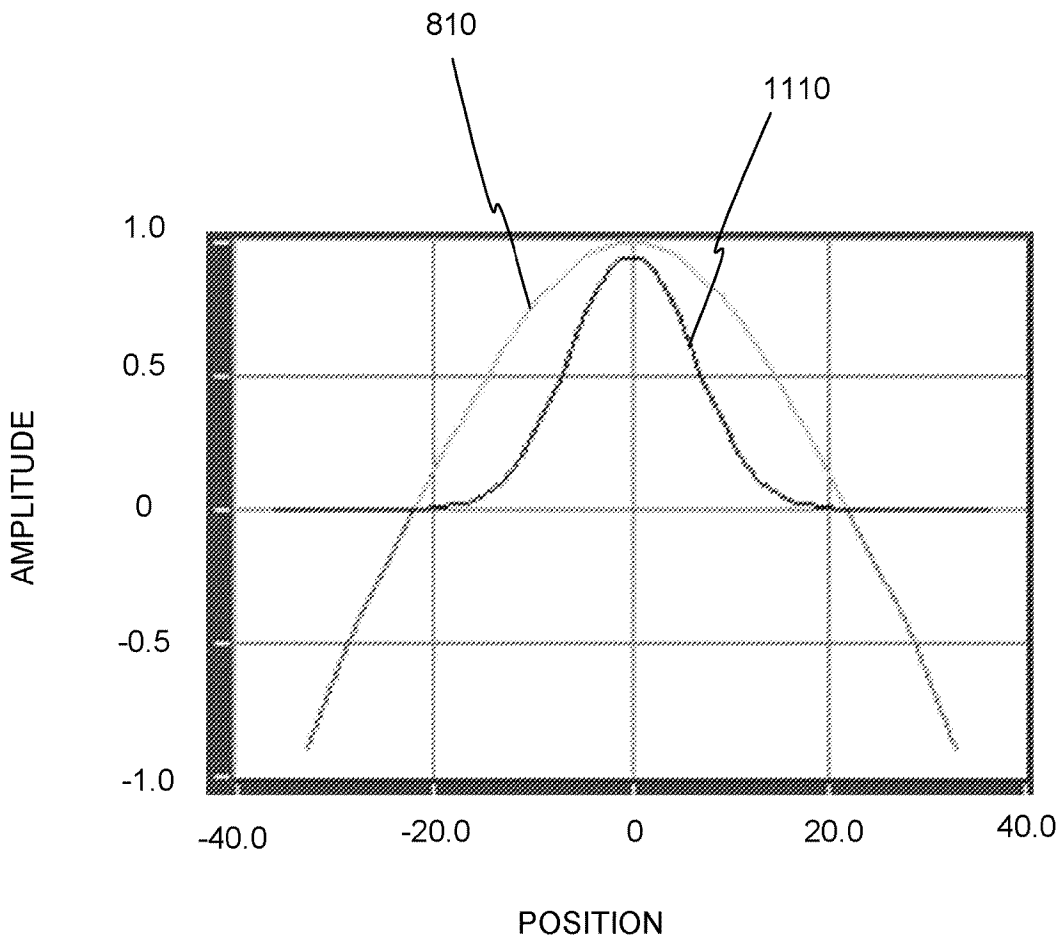
FIG. 11 is an exemplary plot of the amplitude of the induced charge versus position measured at the short pickup electrode of the conventional ELIT of FIG. 1 superimposed on the plot of the amplitude of the induced charge versus position of FIG. 8, which is for a theoretical ELIT with an ideal pickup electrode, in accordance with various embodiments.

FIG. 11 is an exemplary plot 1100 of the amplitude of the induced charge versus position measured at the short pickup electrode of the conventional ELIT of FIG. 1 superimposed on the plot of the amplitude of the induced charge versus position of FIG. 8, which is for a theoretical ELIT with an ideal pickup electrode, in accordance with various embodiments. Induced charge 1110 is measured at the short pickup electrode of the conventional ELIT of FIG. 1. Induced charge 810 is for a theoretical ELIT with an ideal pickup electrode.

Comparing induced charge 1110 and induced charge 810 shows how the conventional ELIT of FIG. 1 might be improved to reduce higher order harmonics. In particular, the amplitude of induced charge 1110 is 0 when the position of the ion is less than −22.0 or greater than +22.0. This is when the ion is within one of the sets of reflectron plates. As a result, no or very little induced charge is being measured in the conventional ELIT of FIG. 1 when an ion is within one of the sets of reflectron plates. However, as induced charge 810 shows, an ELIT with an ideal pickup electrode would measure induced charge in this region. Consequently, the conventional ELIT of FIG. 1 can be improved by measuring the induced charge within the sets of reflectron plates.

Further, the comparison of induced charge 1110 and induced charge 810 shows that, when an ion is between −22.0 and +22.0 or in the field free region of the conventional ELIT of FIG. 1, induced charge 810 is still less than ideal induced charge 1110. Consequently, the conventional ELIT of FIG. 1 can also be improved by optimizing induced charge measurement in the field free region.

Figure 12:
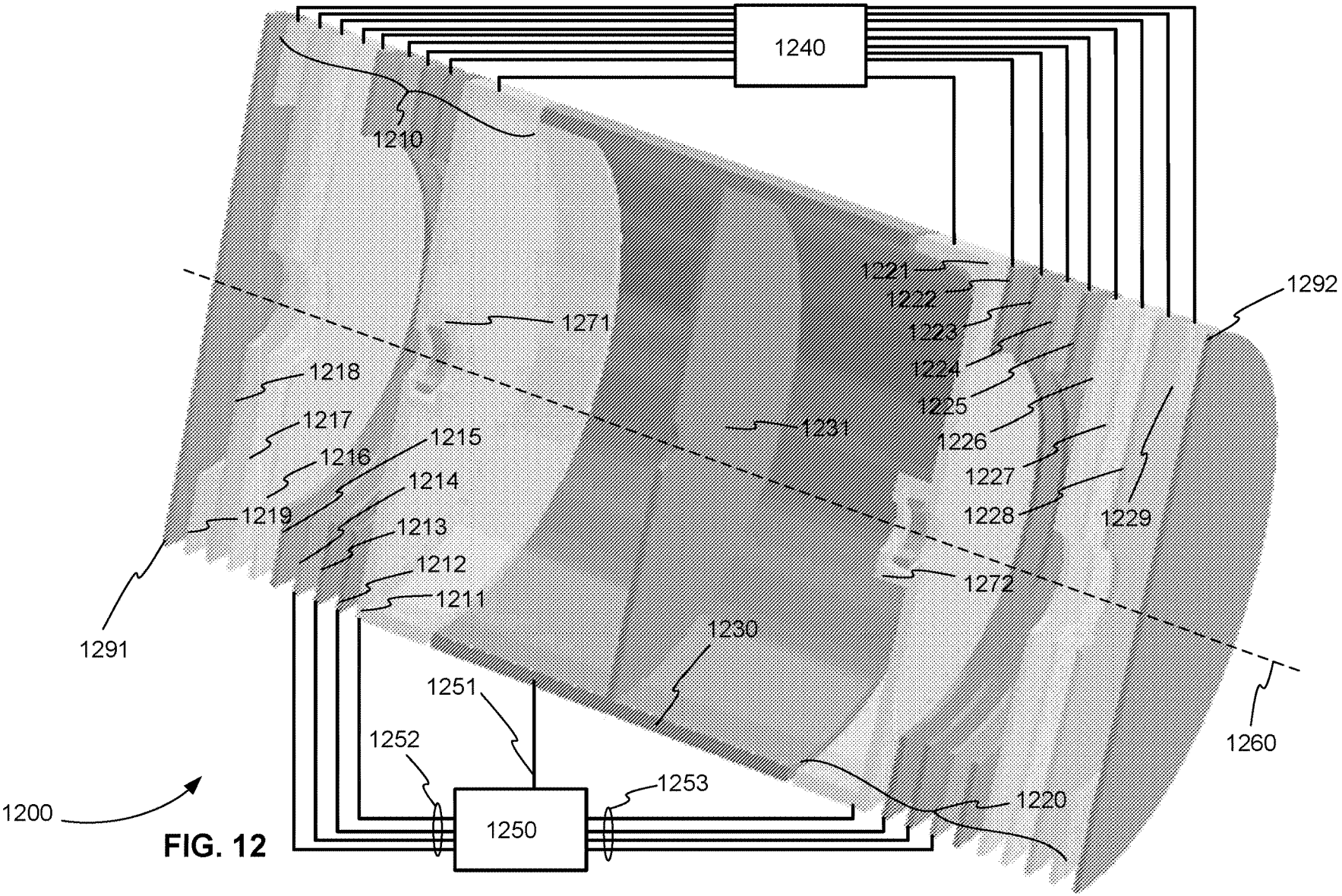
FIG. 12 is a three-dimensional cutaway side view of an ELIT for measuring induced current of one or more ions and reducing higher order frequency harmonics of the induced current by combining the induced current with measurements from reflecting reflectron plates, in accordance with various embodiments.

ELIT for Reducing Higher Order Harmonics by Adding Measurements from Reflecting Plates FIG. 12 is a three-dimensional cutaway side view 1200 of an ELIT for measuring induced current of one or more ions and reducing higher order frequency harmonics of the induced current by combining the induced current with measurements from reflecting reflectron plates, in accordance with various embodiments. The ELIT of FIG. 12 includes first set of reflectron plates 1210, cylindrical pickup electrode 1230, second set of reflectron plates 1220, voltage power supply 1240, and measurement circuitry 1250.

The plates of first set of reflectron plates 1210 each includes holes in the center and are coaxially aligned along central axis 1260. First set of plates 1210 includes first inlet plate 1211 followed by a first plurality of reflection plates and, in turn, followed by a first plurality of trapping plates. The first plurality of reflection plates include plates 1212, 1213, 1214, and 1215. The first plurality of trapping plates include plates 1216, 1217, 1218, and 1219. Plate 1291 is not part of the ELIT and is only used for simulation purposes.

Cylindrical pickup electrode 1230 is positioned so that a first end of pickup electrode 1230 is adjacent to first inlet plate 1211 of first set of plates 1210 and pickup electrode 1230 is coaxially aligned with first set of plates 1210 along central axis 1260.

The plates of second set of reflectron plates 1220 also each includes holes in the center and are coaxially aligned along central axis 1260. Second set of plates 1220 includes second inlet plate 1221 followed by a second plurality of reflection plates and, in turn, followed by a second plurality of trapping plates. The second plurality of reflection plates include plates 1222, 1223, 1224, and 1225. The second plurality of trapping plates include plates 1226, 1227, 1228, and 1229. Plate 1292 is not part of the ELIT and is only used for simulation purposes. Second set of plates 1220 is positioned so that second inlet plate 1221 is adjacent to a second end of cylindrical pickup electrode 1230.

Voltage power supply 1240 applies pulsed voltages to one or more plates of first set of plates 1210 and one or more plates of second set of plates 1220 are held at their static trapping potentials. In this manner, the accepted m/z range of the device is extended. In this case, voltage power supply 1240 applies separate voltages to nine plates of first set of trapping plates 1210 and to nine plates of second set of plates 1220. Inlet plates 1211 and 1221 can have a zero voltage, for example. These voltages are applied in order to trap and then oscillate one or more ions between first set of plates 1210 and second set of plates 1220. The one or more ions have been received along central axis 1260 through the holes of first set of plates 1210, for example.

Voltage power supply 1240 can be one power supply with multiple outputs that can supply multiple different voltages as shown in FIG. 12. In various other embodiments, voltage power supply 1240 can be two or more separate power supplies.

Figure 13:
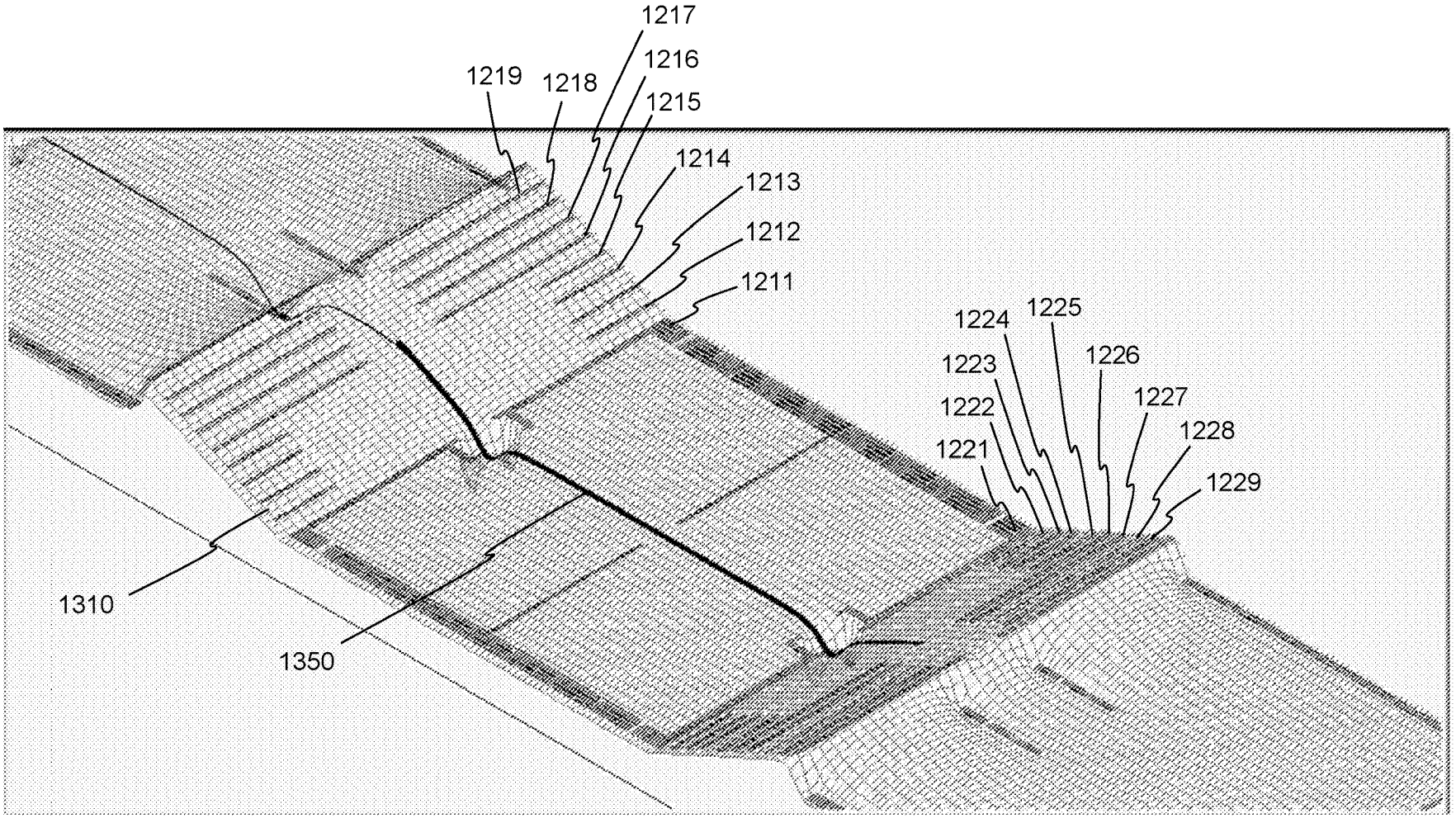
FIG. 13 is an exemplary plot of the electric field produced in the ELIT of FIG. 12 by the voltages applied to the reflectron plates, in accordance with various embodiments.

FIG. 13 is an exemplary plot 1300 of the electric field produced in the ELIT of FIG. 12 by the voltages applied to the reflectron plates, in accordance with various embodiments. Reflectron plates 1211, 1212, 1213, 1214, 1215, 1216, 1217, 1218, and 1219 are biased with increasingly higher positive voltages for positively charged ions or increasingly lower negative voltages for negatively charged ions. Similarly, reflectron plates 1221, 1222, 1223, 1224, 1225, 1226, 1227, 1228, and 1229 are biased with the same increasingly higher positive voltages for positively charged ions or increasingly lower negative voltages for negatively charged ions.

The voltages applied to the reflectron plates at either end of the ELIT produce an electric field 1310. Electric field 1310 causes the one or more ions that are introduced axially into the ELIT to oscillate along path 1350 between the reflectron plates at either end of the ELIT. Essentially, the voltages applied to the reflectron plates at either end of the ELIT produce a potential well for the one or more ions.

Figure 14:
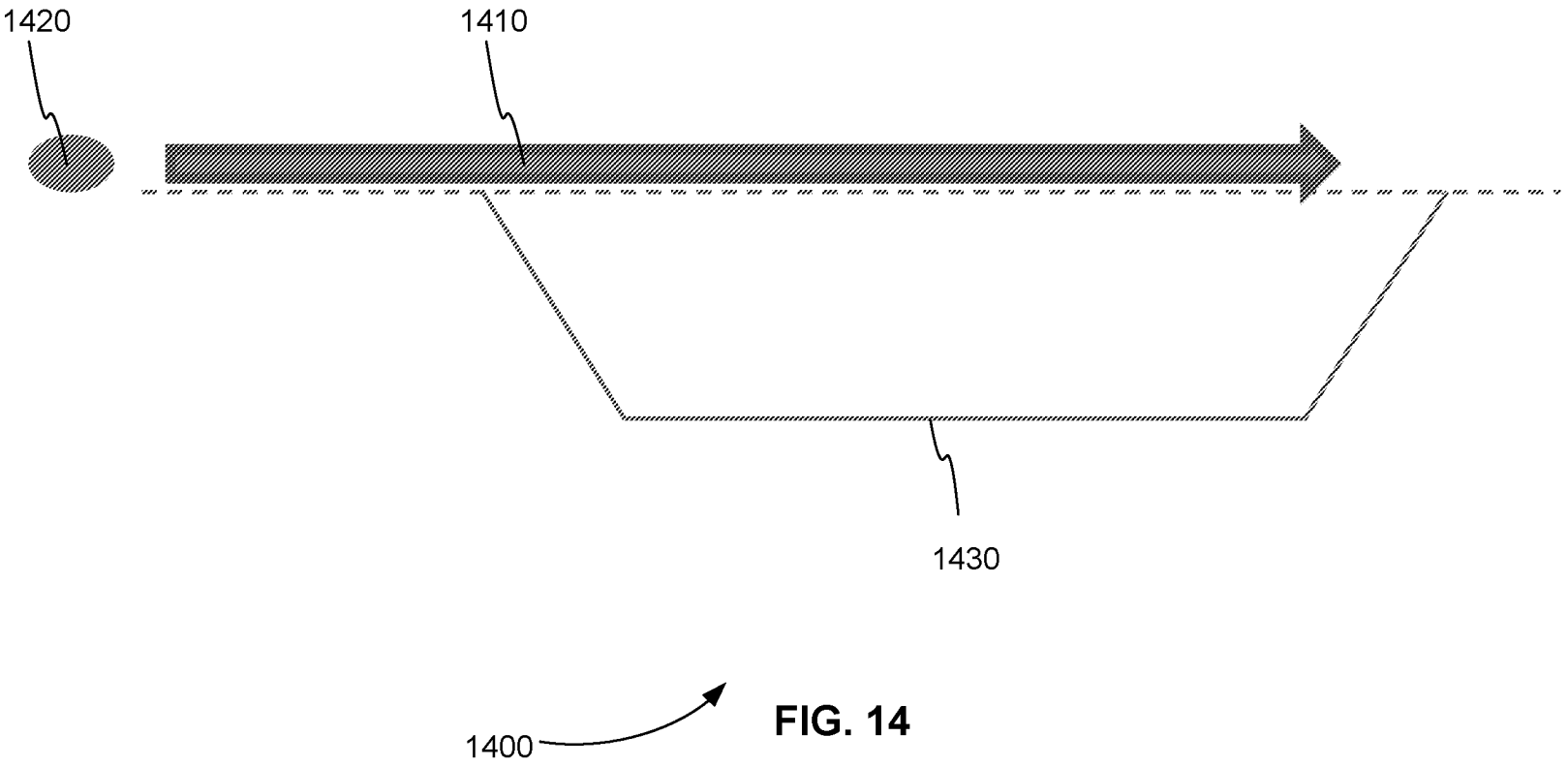
FIG. 14 is an exemplary diagram of the potential well produced by the electric field of FIG. 13, without the focusing lenses, showing how an ion is received into the potential well of the ELIT, in accordance with various embodiments.

FIG. 14 is an exemplary diagram 1400 of the potential well produced by the electric field of FIG. 13, without the focusing lenses, showing how an ion is received into the potential well of the ELIT, in accordance with various embodiments. Path 1410 depicts the path followed by an ion 1420 that is introduced axially into potential well 1430. The electric field walls of potential well 1430 are lowered, for example, to allow ion 1420 to be introduced.

Figure 15:
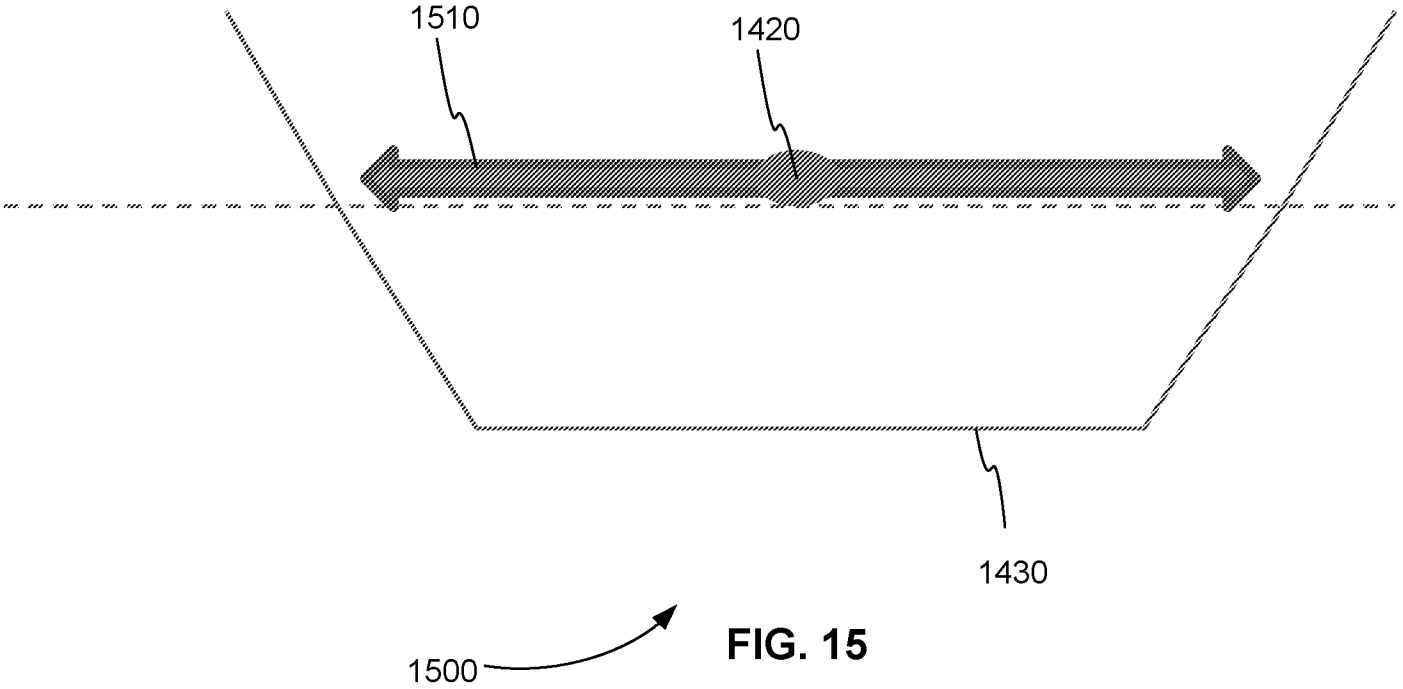
FIG. 15 is an exemplary diagram of the potential well produced by the electric field of FIG. 13, without the focusing lenses, showing how an ion is trapped in the potential well of the ELIT, in accordance with various embodiments.

FIG. 15 is an exemplary diagram 1500 of the potential well produced by the electric field of FIG. 13, without the focusing lenses, showing how an ion is trapped in the potential well of the ELIT, in accordance with various embodiments. Path 1510 depicts the oscillating path followed by ion 1420 when ion 1420 is trapped in potential well 1430. The electric field walls of potential well 1430 are raised, for example, to trap ion 1420 in potential well 1430.

Figure 16:
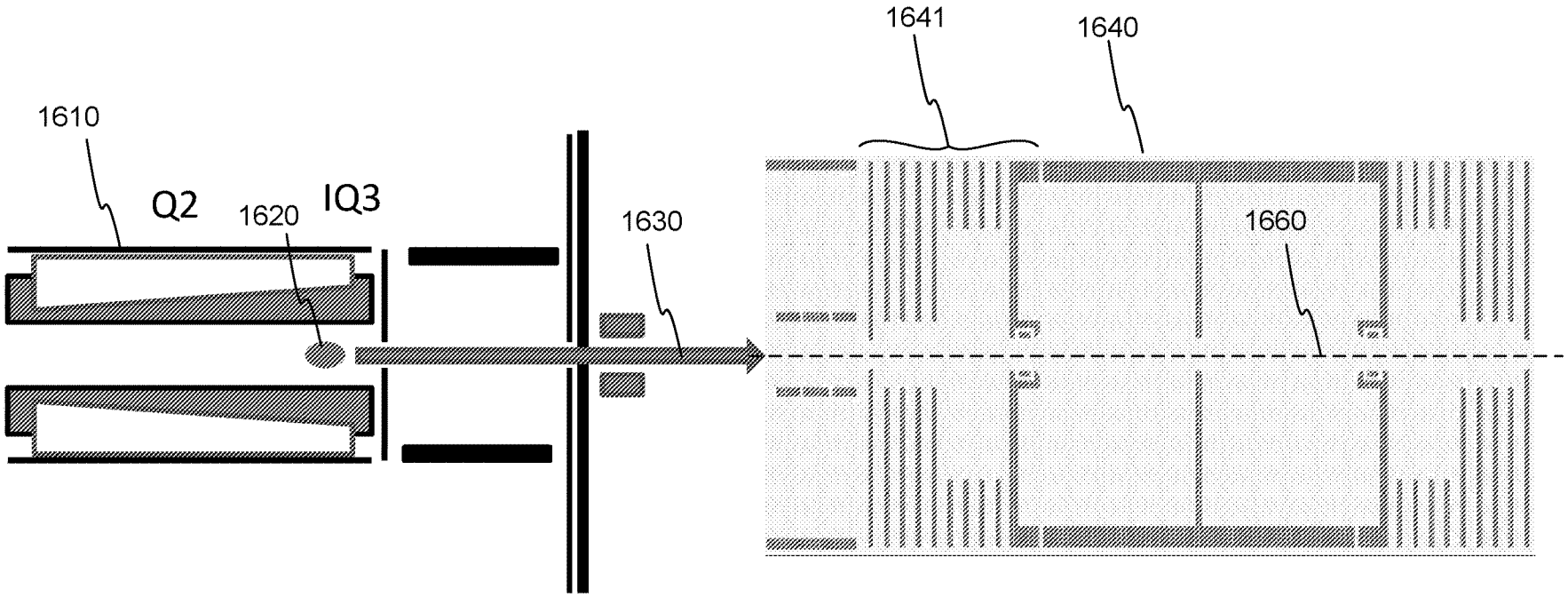
FIG. 16 is an exemplary diagram of a portion of an ELIT-MS showing how an ion is introduced into an ELIT from a quadrupole, in accordance with various embodiments.

FIG. 16 is an exemplary diagram 1600 of a portion of an ELIT-MS showing how an ion is introduced into an ELIT from a quadrupole, in accordance with various embodiments. For example, ion 1620 is ejected from quadrupole 1610 along path 1630 and injected into ELIT 1640. Ion 1620 is injected into ELIT 1640 along central axis 1660 through the holes of first set of reflectron plates 1641.

Returning to FIG. 12, measurement circuitry 1250 is used to measure first induced current 1251 from cylindrical pickup electrode 1230, second induced current 1252 from one or more plates of first set of reflectron plates 1210 and third induced current 1253 from one or more plates of the second set of reflectron plates 1220. Measurement circuitry 1250 combines first measured induced current 1251 with second measured induced current 1252 and third measured induced current 1253 to determine an induced current of the one or more ions. The use of second measured induced current 1252 and third measured induced current 1253 in addition to first measured induced current 1251 reduces higher order frequency harmonics of the induced current.

Measurement circuitry 1250 can be one circuit for detecting, filtering, and combining the measured induced currents or can be two or more separate circuits, for example.

Various additional embodiments also further reduce higher order frequency harmonics of the induced current.

In various embodiments, one or more plates of first set of reflectron plates 1210 include first inlet plate 1211 and one or more plates (1212, 1213, and 1214) of the first plurality of reflection plates, and one or more plates of second set of reflectron plates 1210 include second inlet plate 1221 and one or more plates (1222, 1223, and 1224) of the second plurality of reflection plates.

In various embodiments, first measured induced current 1251 is combined with second measured induced current 1252 and third measured induced current 1253 by summing second measured induced current 1252, third measured induced current 1253, and twice first measured induced current 1251. In other words, first measured induced current 1251 is multiplied by 2 and summed with second measured induced current 1252 and third measured induced current 1253 to calculate the induced current. The factor of 2 further reduces higher order frequency harmonics of the induced current.

In various embodiments, second measured induced current 1252 and third measured induced current 1253 are adjusted to have the same phase before second measured induced current 1252 and third measured induced current 1253 are summed with twice first measured induced current 1251. For example, the phase of second measured induced current 1252 or third measured induced current 1253 is shifted 180° before second measured induced current 1252 and third measured induced current 1253 are summed with twice first measured induced current 1251.

In various embodiments, cylindrical pickup electrode 1230 includes circular plate 1231 in the middle of cylindrical pickup electrode 1230 and circular plate 1231 has a hole in the center. Circular plate 1231 further reduces higher order frequency harmonics of the induced current.

In various embodiments, the diameter of cylindrical pickup electrode 1230 is half the length of the distance between first set of plates 1210 and the second set of plates 1220. In other words, the diameter of cylindrical pickup electrode 1230 is half the length of the field free region. These dimensions further reduce higher order frequency harmonics of the induced current.

In various embodiments, the hole diameter of the one or more plates of the first plurality of reflection plates is larger than the hole diameter of the other plates of first set of plates 1210, and the hole diameter of the one or more plates of the second plurality of reflection plates is larger than the hole diameter of the other plates of second set of plates 1220. For example, as shown in FIG. 12, the hole diameter of plates 1212, 1213, and 1214, from which induced current is measured, is larger than the hole diameter of plates 1216, 1217, and 1218. Similarly, the hole diameter of plates 1222, 1223, and 1224, from which induced current is measured, is larger than the hole diameter of plates 1226, 1227, and 1228. These dimensions further reduce higher order frequency harmonics of the induced current.

In various embodiments, first inlet plate 1211 further includes first focusing lens 1271 around the hole of first inlet plate 1211 to focus the one or more ions radially. Similarly, second inlet plate 1221 further includes second focusing lens 1272 around the hole of second inlet plate 1221 to focus the one or more ions radially.

Figure 17:
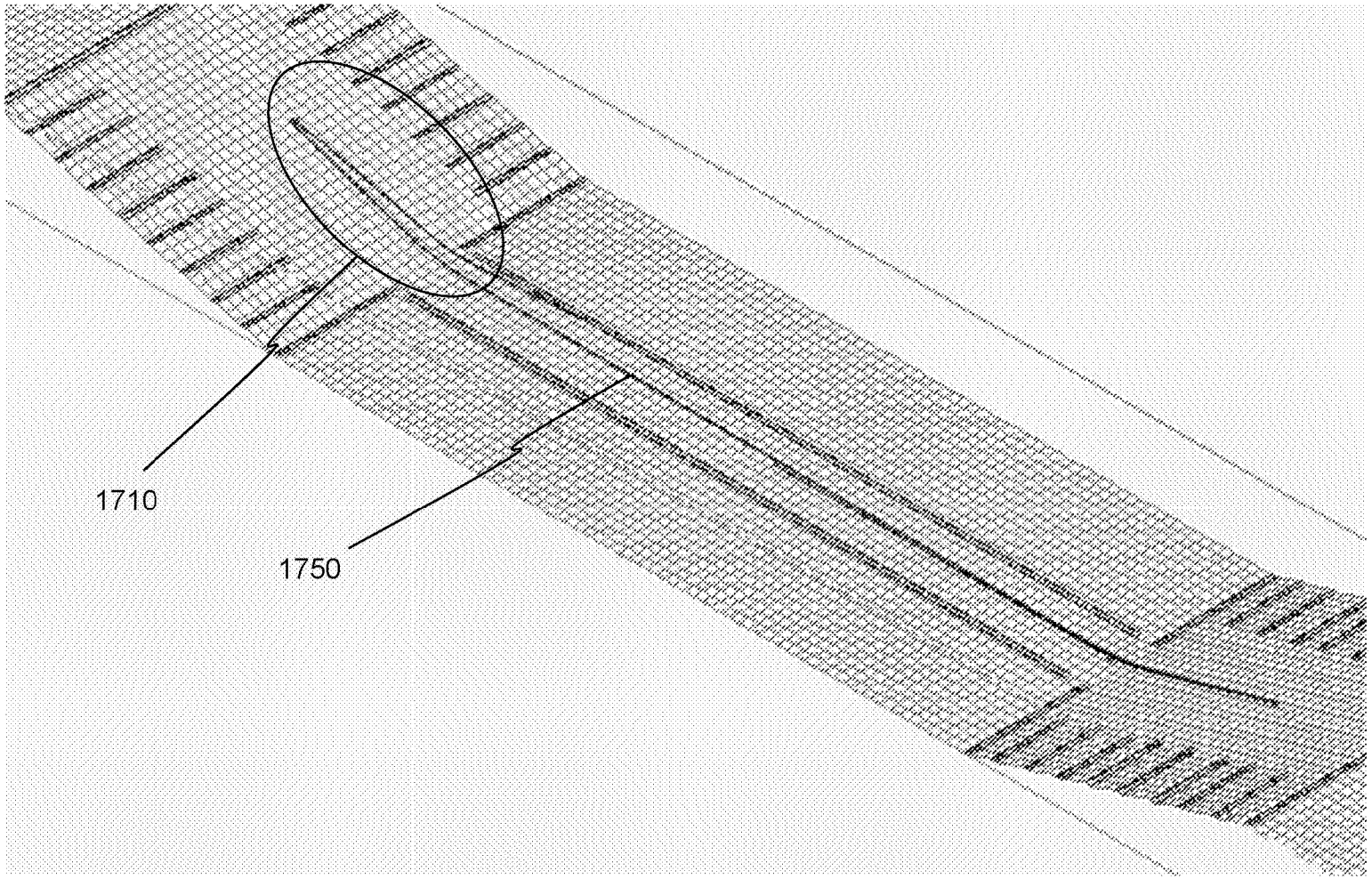
(PRIOR ART) FIG. 17
FIG. 17 an exemplary plot of the electric field produced in an ELIT without focusing lenses and shows how ions can disperse radially along the ion path without radial focusing.

FIG. 17 an exemplary plot 1700 of the electric field produced in an ELIT without focusing lenses and shows how ions can disperse radially along the ion path without radial focusing. For example, without radial focusing, ions along ion path 1750 begin to disperse radially within the reflectron plates in region 1710. This dispersion can result in the loss of ions and, therefore, a reduced signal.

Returning to FIG. 12, in various embodiments, the ELIT further includes processing circuitry (not shown). This processing circuitry receives the induced current from measurement circuitry 1250, performs a Fourier transform on the induced current to determine one or more oscillation frequencies of the one or more ions, and calculates mass-to-charge ratios of the one or more ions from the one or more oscillation frequencies. The processing circuitry can include a general purpose processor, such as a computer, a microprocessor, microcontroller, or a digital signal processor. In various embodiments, the processing circuitry can also include a specific circuit developed for performing these functions.

Figure 18:
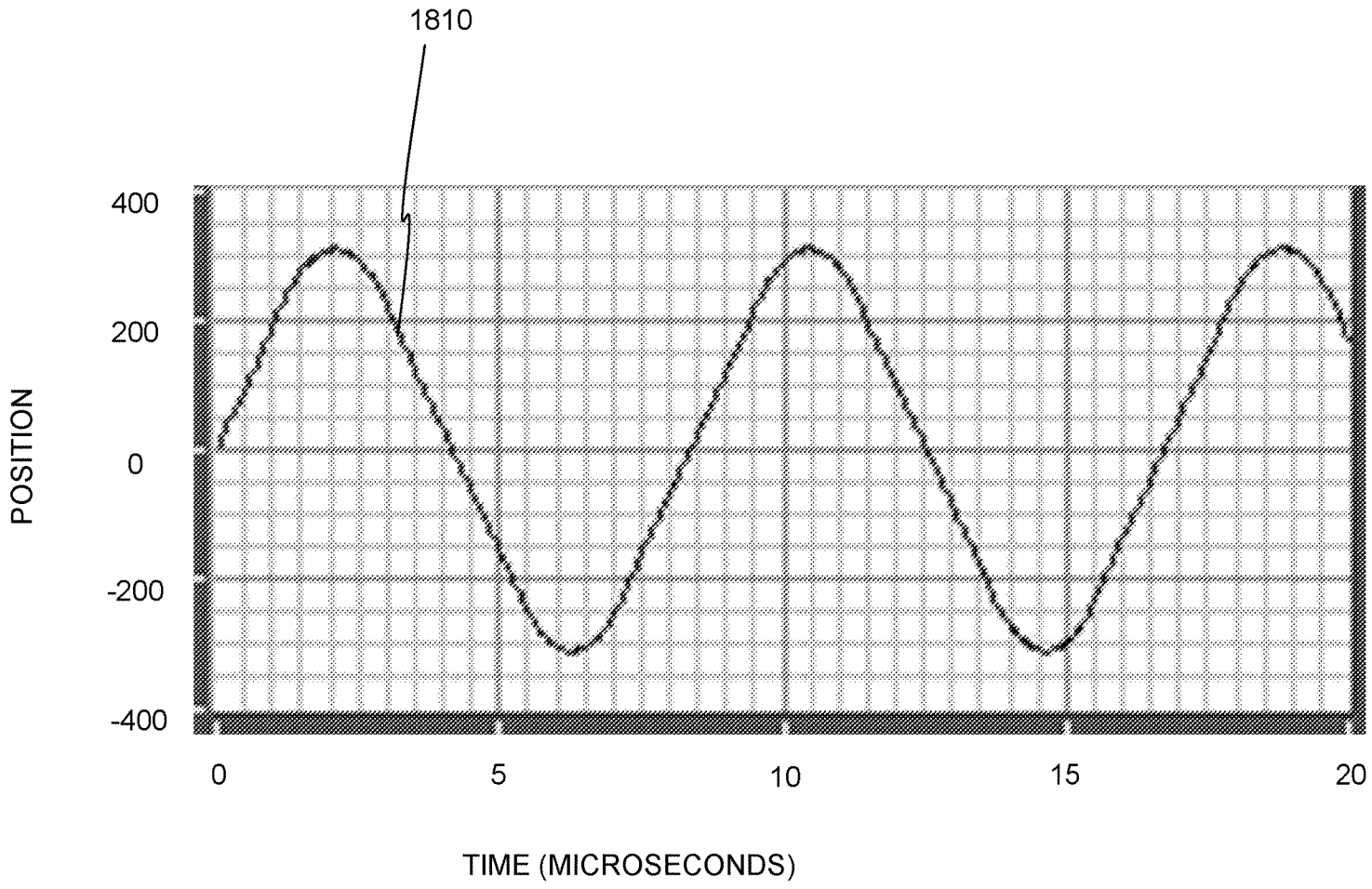
FIG. 18 is an exemplary plot showing the sinusoidal trajectory of an ion in the ELIT of FIG. 12, in accordance with various embodiments.

FIG. 18 is an exemplary plot 1800 showing the sinusoidal trajectory of an ion in the ELIT of FIG. 12, in accordance with various embodiments. Sinusoidal trajectory 1810 shows the position of an ion with respect to time. Comparing plot 1800 to plot 700 of FIG. 7 shows that sinusoidal trajectory 1810 in the ELIT of FIG. 12 is essentially equivalent to sinusoidal trajectory 701 of a conventional ELIT.

Figure 19:
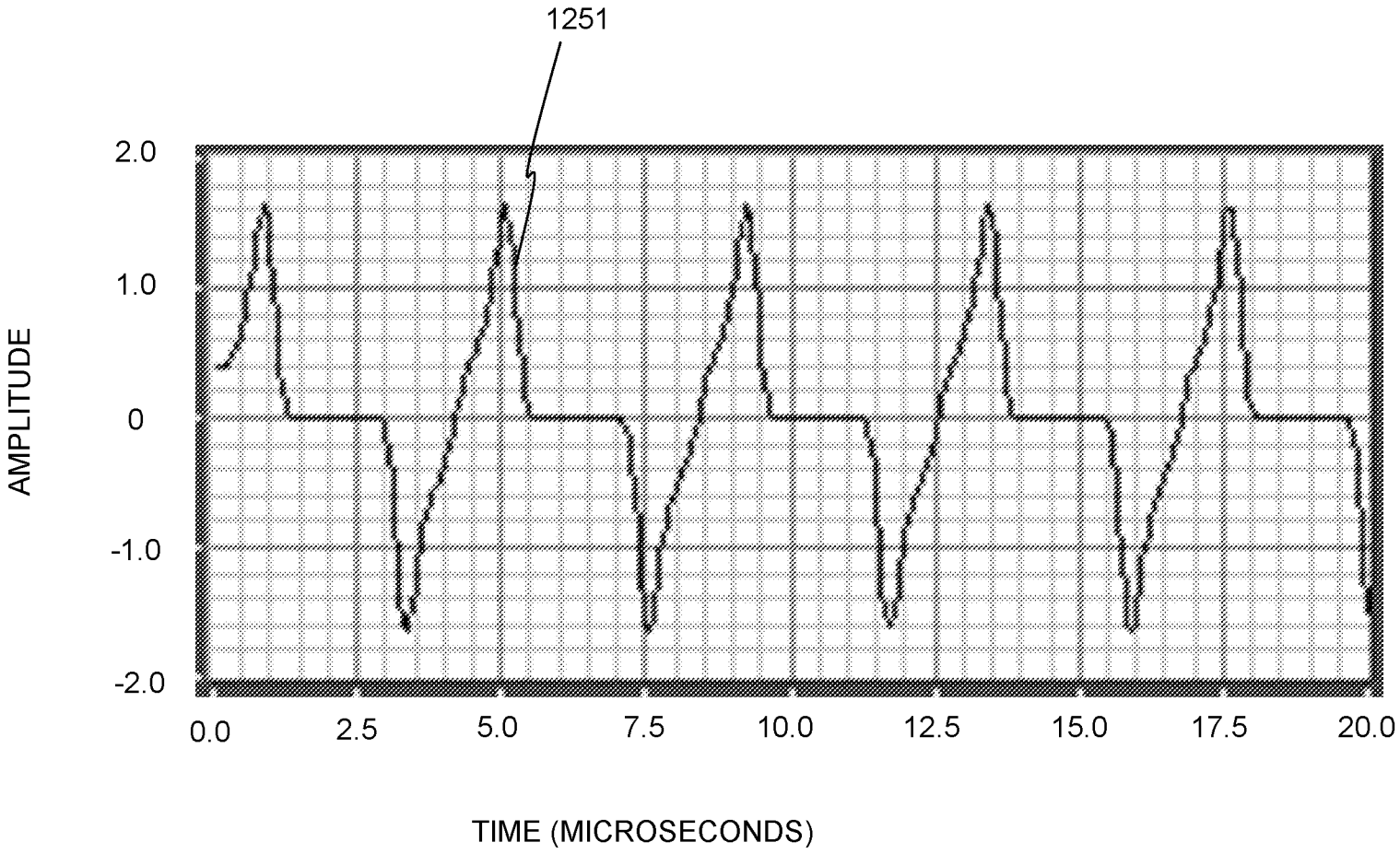
FIG. 19 is an exemplary plot showing the first measured induced current for an ion in the ELIT of FIG. 12, in accordance with various embodiments.

FIG. 19 is an exemplary plot 1900 showing the first measured induced current for an ion in the ELIT of FIG. 12, in accordance with various embodiments. Plot 1900 shows that first measured induced current 1251 for an ion is not a perfect of ideal sinusoid. Measured induced current 1251 is similar to measured induced current 510 of FIG. 5 of a conventional ELIT but is not identical due to the changes made to the ELIT of FIG. 12.

Figure 20:
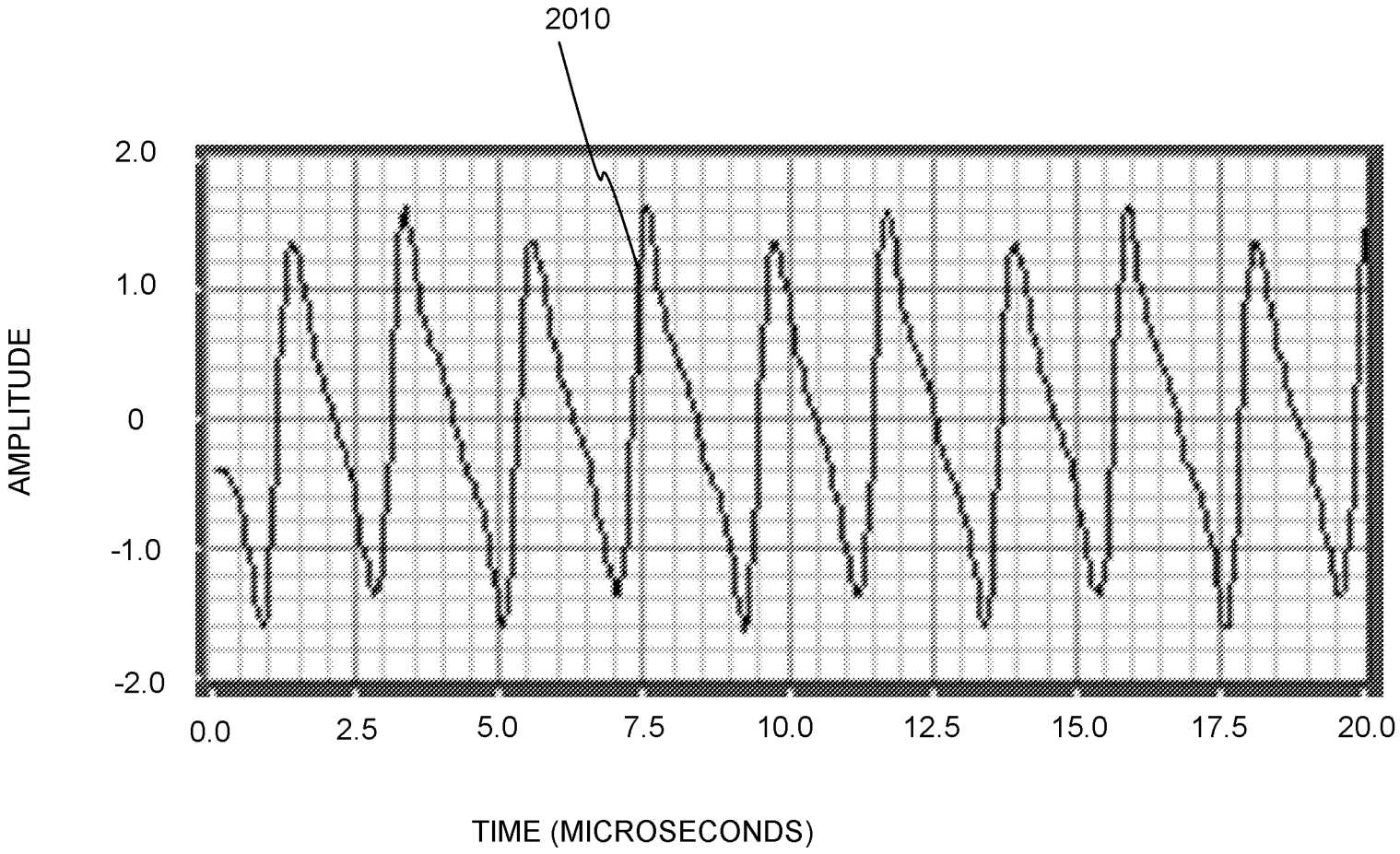
FIG. 20 is an exemplary plot showing the sum of the second measured induced current and the third measured induced current for an ion in the ELIT of FIG. 12, in accordance with various embodiments.

FIG. 20 is an exemplary plot 2000 showing the sum of the second measured induced current and the third measured induced current for an ion in the ELIT of FIG. 12, in accordance with various embodiments. In plot 2000, induced current 2010 is the sum of second measured induced current 1252 and third measured induced current 1253 of FIG. 12 after an appropriate phase correction.

Figure 21:
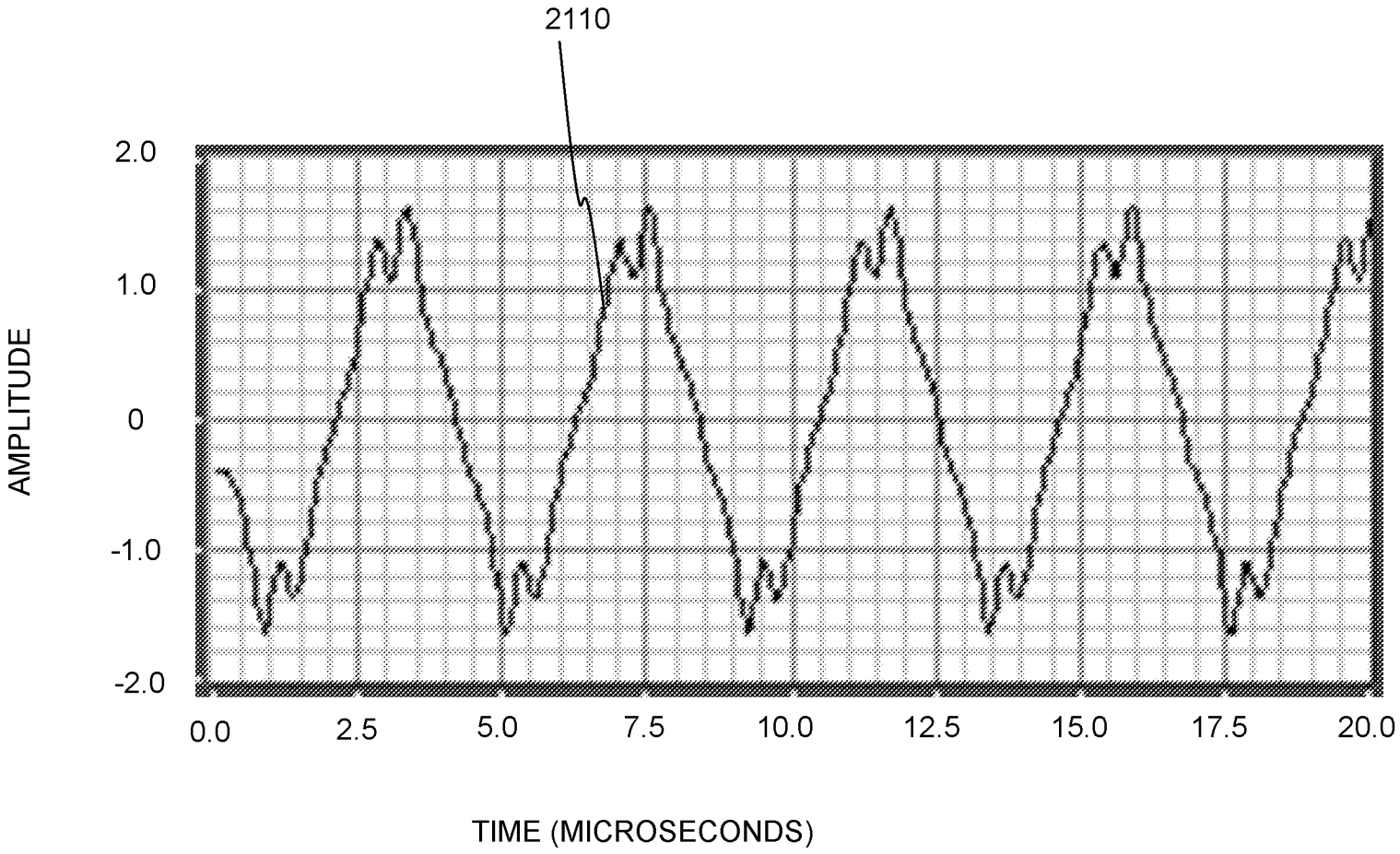
FIG. 21 is an exemplary plot showing the sum of twice the first measured induced current of FIG. 19 and the sum of the second measured induced current and the third measured induced current of FIG. 20, in accordance with various embodiments.

FIG. 21 is an exemplary plot 2100 showing the sum of twice the first measured induced current of FIG. 19 and the sum of the second measured induced current and the third measured induced current of FIG. 20, in accordance with various embodiments. In other words, induced current 2110 is the sum of second measured induced current 1252 of FIG. 12, third measured induced current 1253 of FIG. 12, and twice first measured induced current 1251 of FIG. 12. More simply, induced current 2110 of FIG. 21 is the overall induced current produced by measurement circuitry 1250 of the ELIT of FIG. 12.

Figure 5:
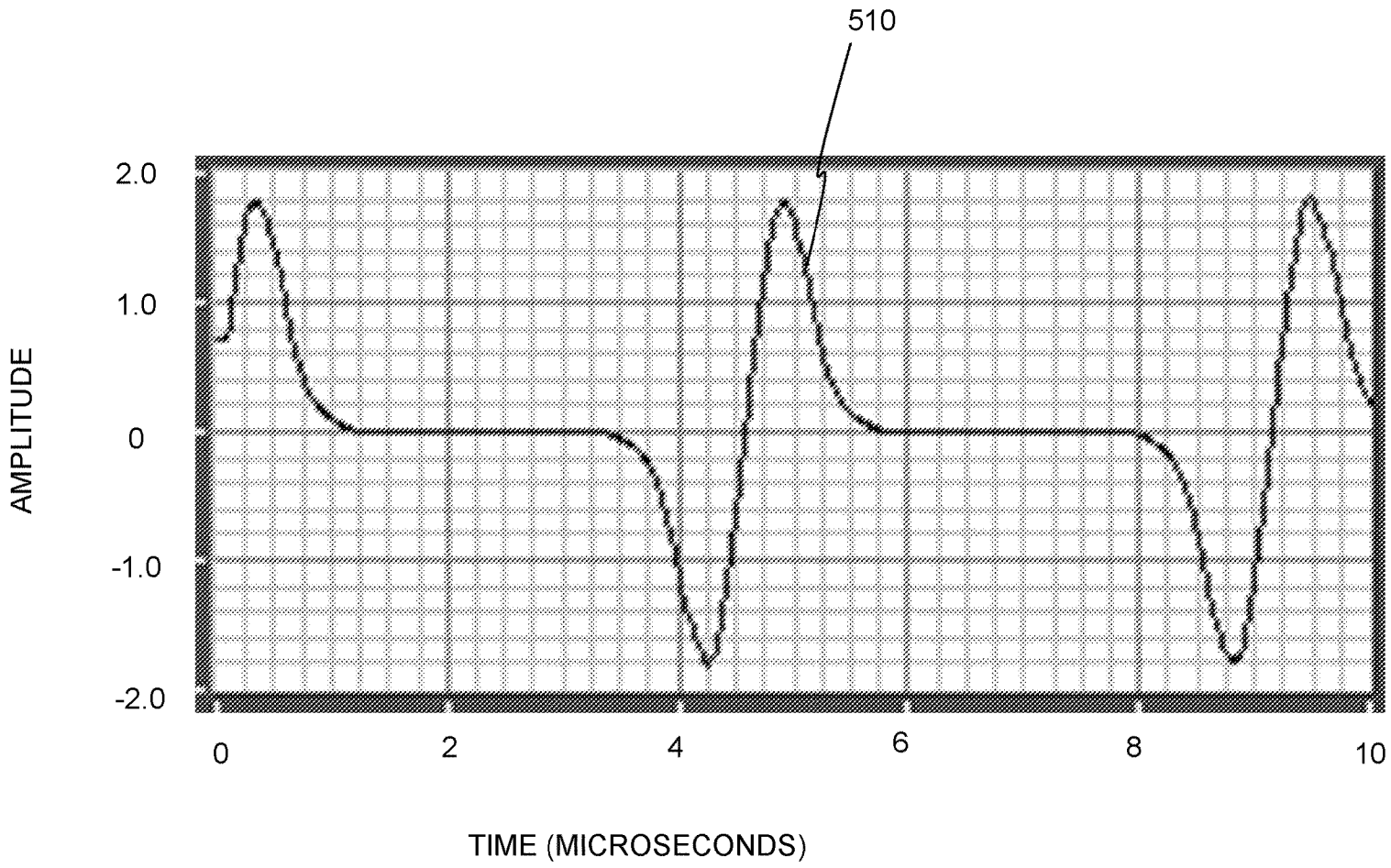
(PRIOR ART) FIG. 5
FIG. 5 is an exemplary plot showing the measured induced current for an ion in a conventional ELIT.

FIG. 5 shows induced current 510 measured by the conventional ELIT of FIG. 1. A comparison of induced current 510 of FIG. 5 with induced current 2110 of FIG. 21 shows that the ELIT of FIG. 12 can produce an induced current measurement that is more sinusoidal in shape than the conventional ELIT of FIG. 1.

FIG. 9 shows induced current 910 of a theoretical ELIT that includes an ideal pickup electrode. A comparison of induced current 910 of FIG. 9 with induced current 2110 of FIG. 21 shows that the ELIT of FIG. 12 can produce an induced current measurement that is closer to an ideal sinusoidal shape than the conventional ELIT of FIG. 1.

Figure 22:
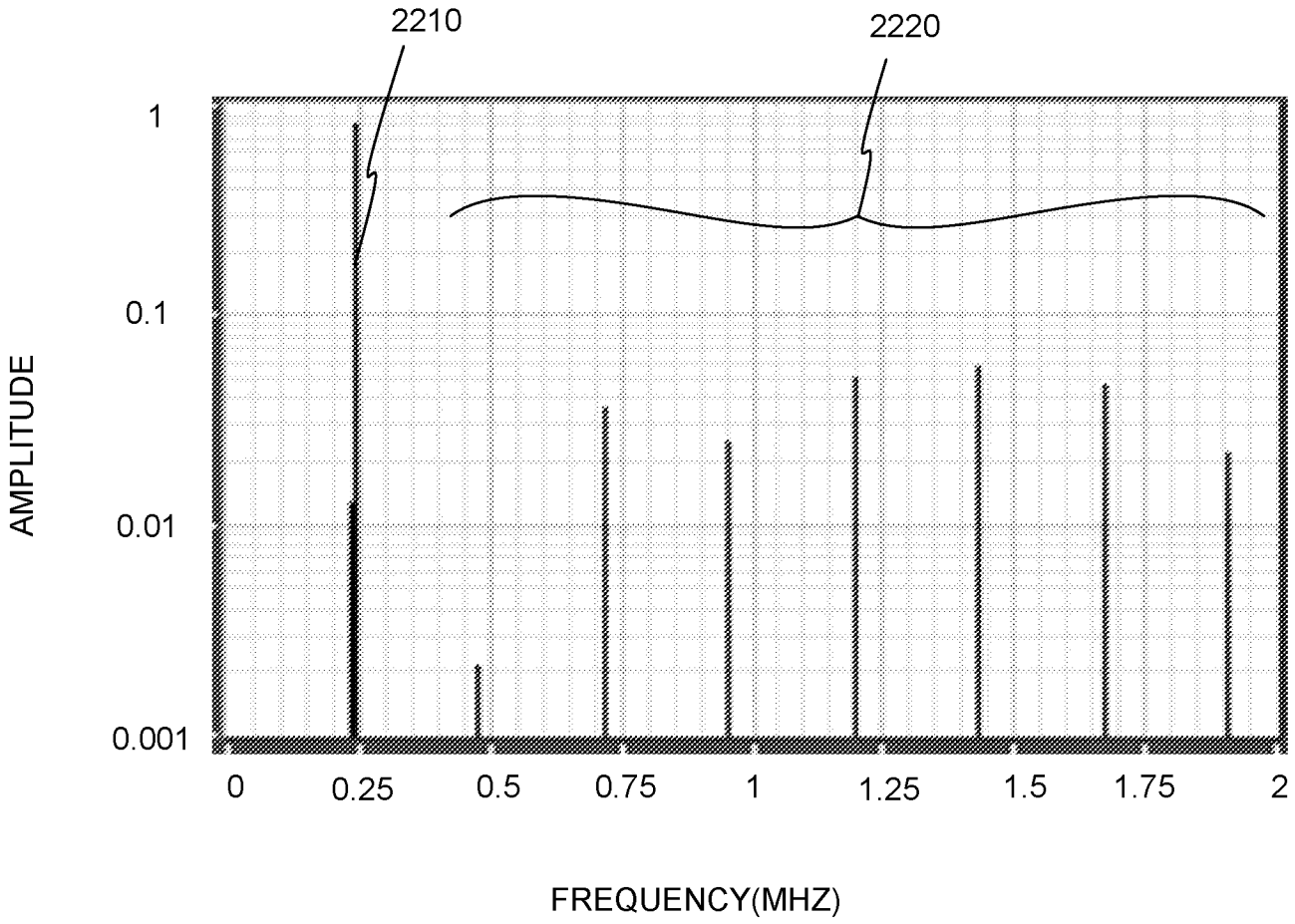
FIG. 22 is an exemplary plot showing the fundamental frequency and higher order harmonics obtained by applying a Fourier transform to the measured induced current of FIG. 21, in accordance with various embodiments.

FIG. 22 is an exemplary plot 2200 showing the fundamental frequency and higher order harmonics obtained by applying a Fourier transform to the measured induced current of FIG. 21, in accordance with various embodiments. Plot 2200 includes fundamental frequency 2210 and higher order harmonics 2220.

Figure 6:
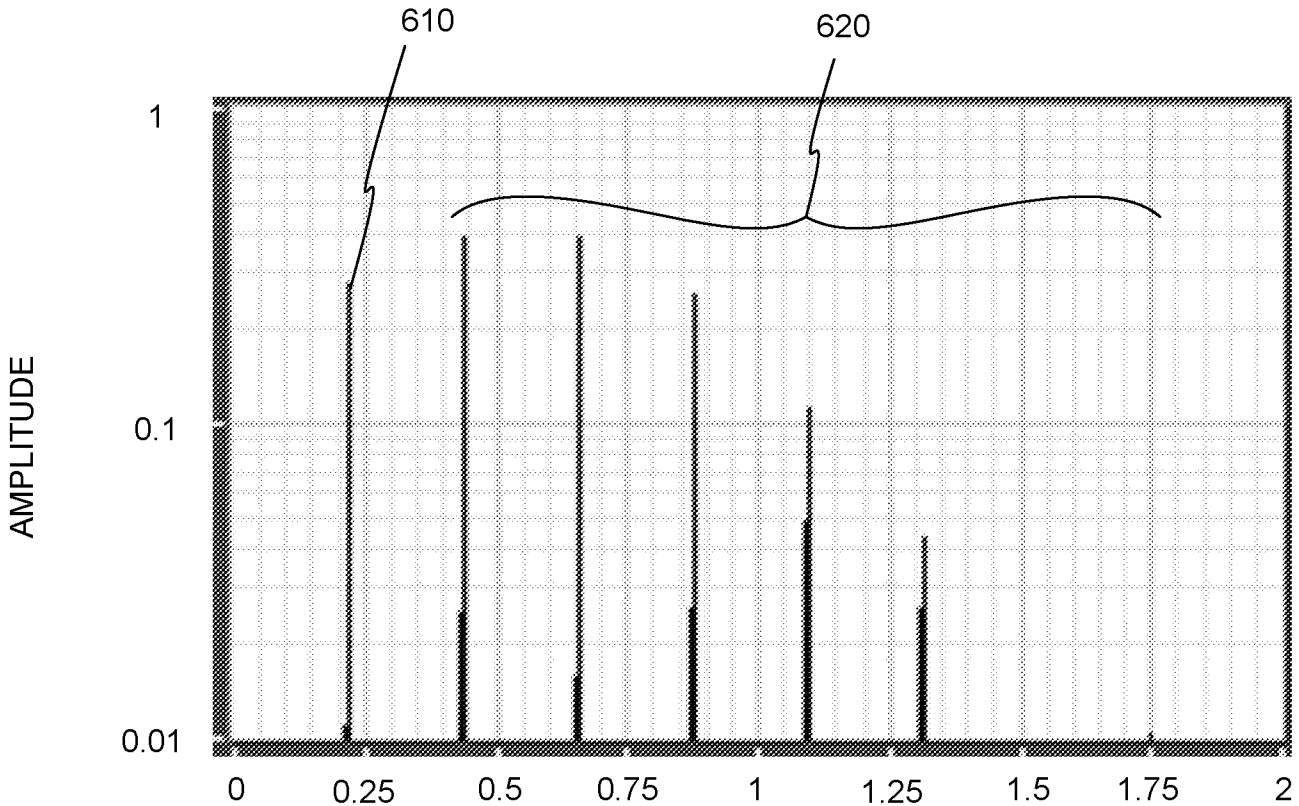
FIG. 6 is an exemplary plot showing the fundamental frequency and higher order harmonics obtained by applying a Fourier transform to the measured induced current for an ion in a conventional ELIT.

Plot 600 of FIG. 6 shows the fundamental frequency and higher order harmonics obtained by applying a Fourier transform to the measured induced current for the conventional ELIT of FIG. 1. A comparison of plot 600 of FIG. 6 with plot 2200 of FIG. 22 shows that the ELIT of FIG. 12 is able to reduce the amplitudes of higher order harmonics.

Plot 1000 of FIG. 10 shows the fundamental frequency and higher order harmonics obtained by applying a Fourier transform to the induced current of a theoretical ELIT with an ideal pickup electrode. A comparison of plot 1000 of FIG. 10 with plot 2200 of FIG. 22 shows that the ELIT of FIG. 12 is almost able to reduce the amplitudes of higher order harmonics as well as the theoretical ELIT with an ideal pickup electrode.

Figure 23:
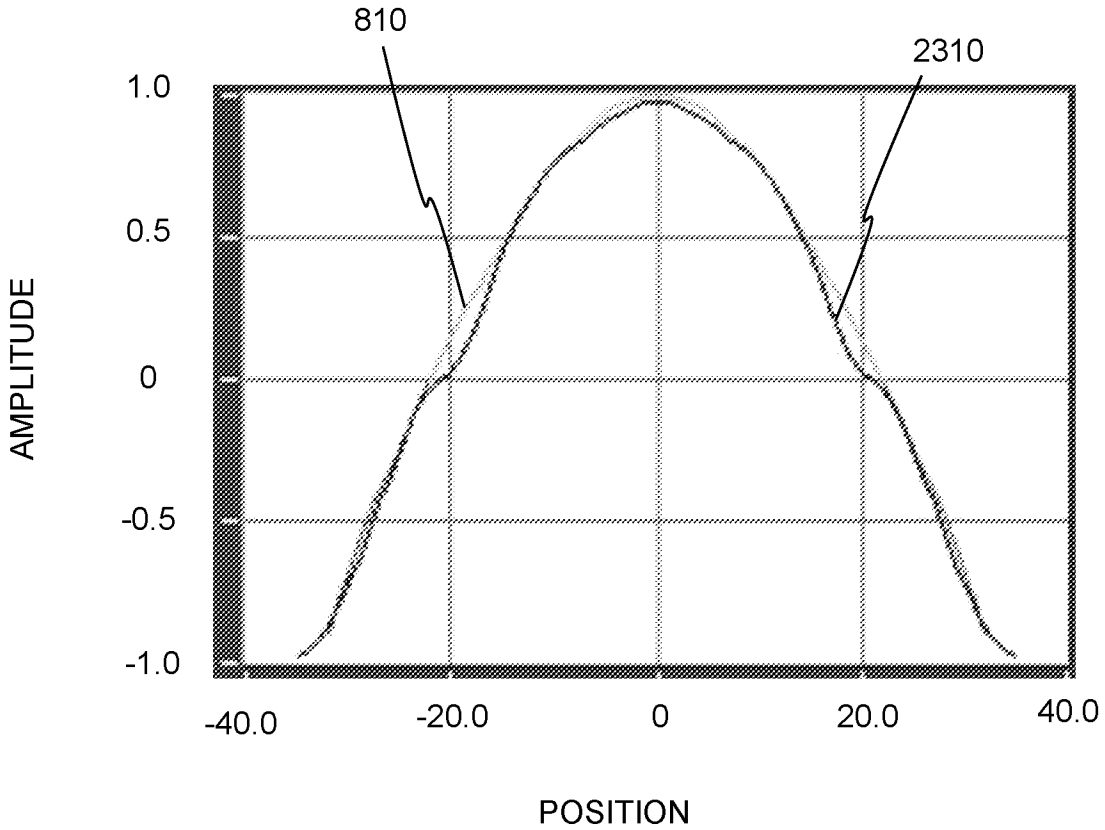
FIG. 23 is an exemplary plot of the amplitude of the combined induced charge versus position produced by the measurement circuitry of the ELIT of FIG. 12 superimposed on the plot of the amplitude of the induced charge versus position of FIG. 8, which is for a theoretical ELIT with an ideal pickup electrode, in accordance with various embodiments.

FIG. 23 is an exemplary plot 2300 of the amplitude of the combined induced charge versus position produced by the measurement circuitry of the ELIT of FIG. 12 superimposed on the plot of the amplitude of the induced charge versus position of FIG. 8, which is for a theoretical ELIT with an ideal pickup electrode, in accordance with various embodiments. Combined induced charge 2310 is produced by the measurement circuitry of the ELIT of FIG. 12. Induced charge 810 is for a theoretical ELIT with an ideal pickup electrode.

Combined induced charge 2310 and induced charge 810 are very similar in shape.

This shows that the ELIT of FIG. 12 is able to closely mimic a theoretical ELIT with an ideal pickup electrode.

Plot 1100 of FIG. 11 shows the amplitude of the induced charge versus position measured at the short pickup electrode of the conventional ELIT of FIG. 1 superimposed on the plot of the amplitude of the induced charge versus position of FIG. 8, which is for a theoretical ELIT with an ideal pickup electrode. A comparison of plot 2300 of FIG. 23 with plot 1100 of FIG. 11 shows that the ELIT of FIG. 12 is able to produce an induced charge much closer to an ideal induced charge than the ELIT of FIG. 1.

Figure 24:
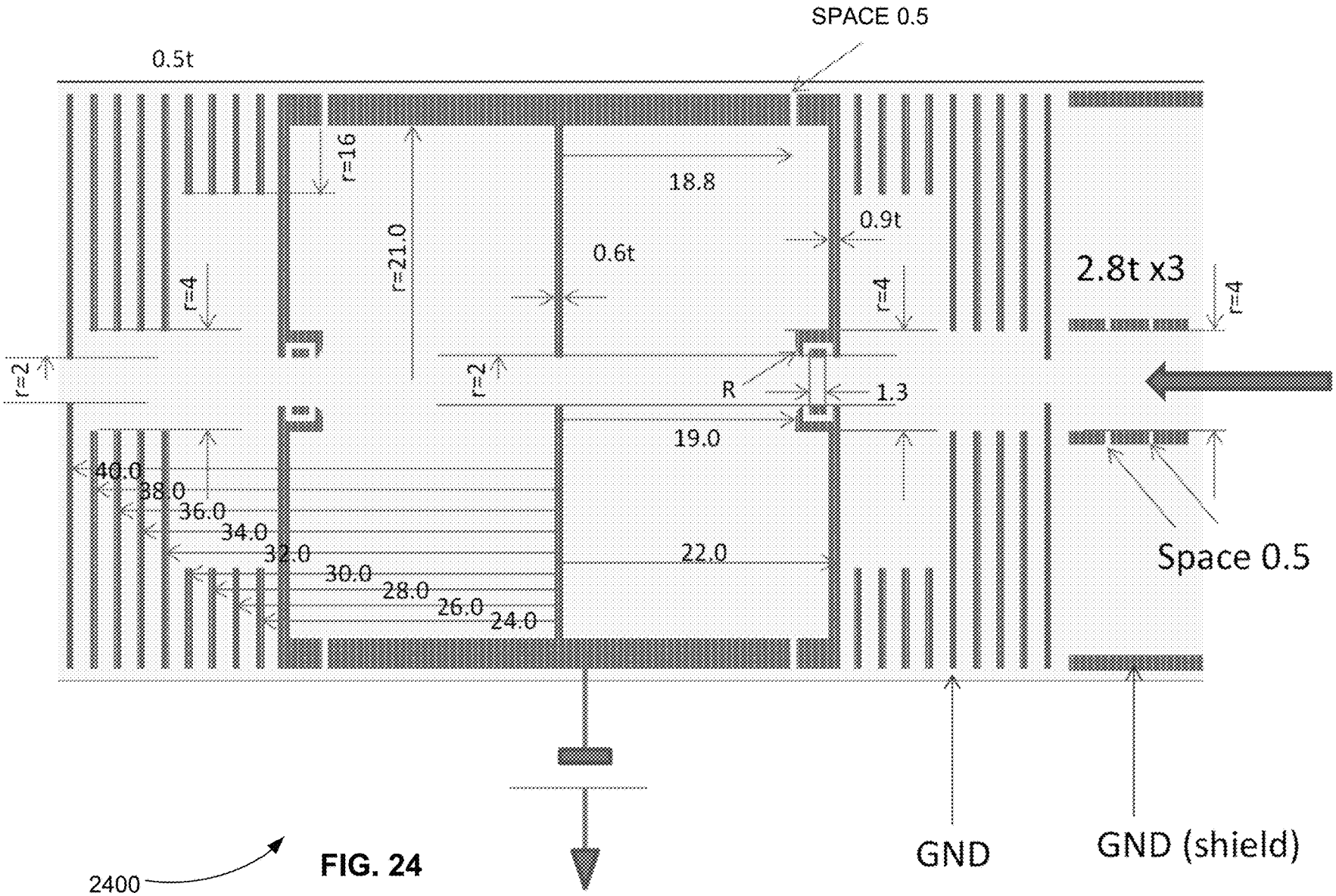
FIG. 24 is an exemplary cross-sectional side view of the ELIT of FIG. 12 showing some exemplary dimensions and biasing, in accordance with various embodiments.

FIG. 24 is an exemplary cross-sectional side view 2400 of the ELIT of FIG. 12 showing some exemplary dimensions and biasing, in accordance with various embodiments. The dimensions shown in FIG. 24 are provided in millimeters.

Figure 25:
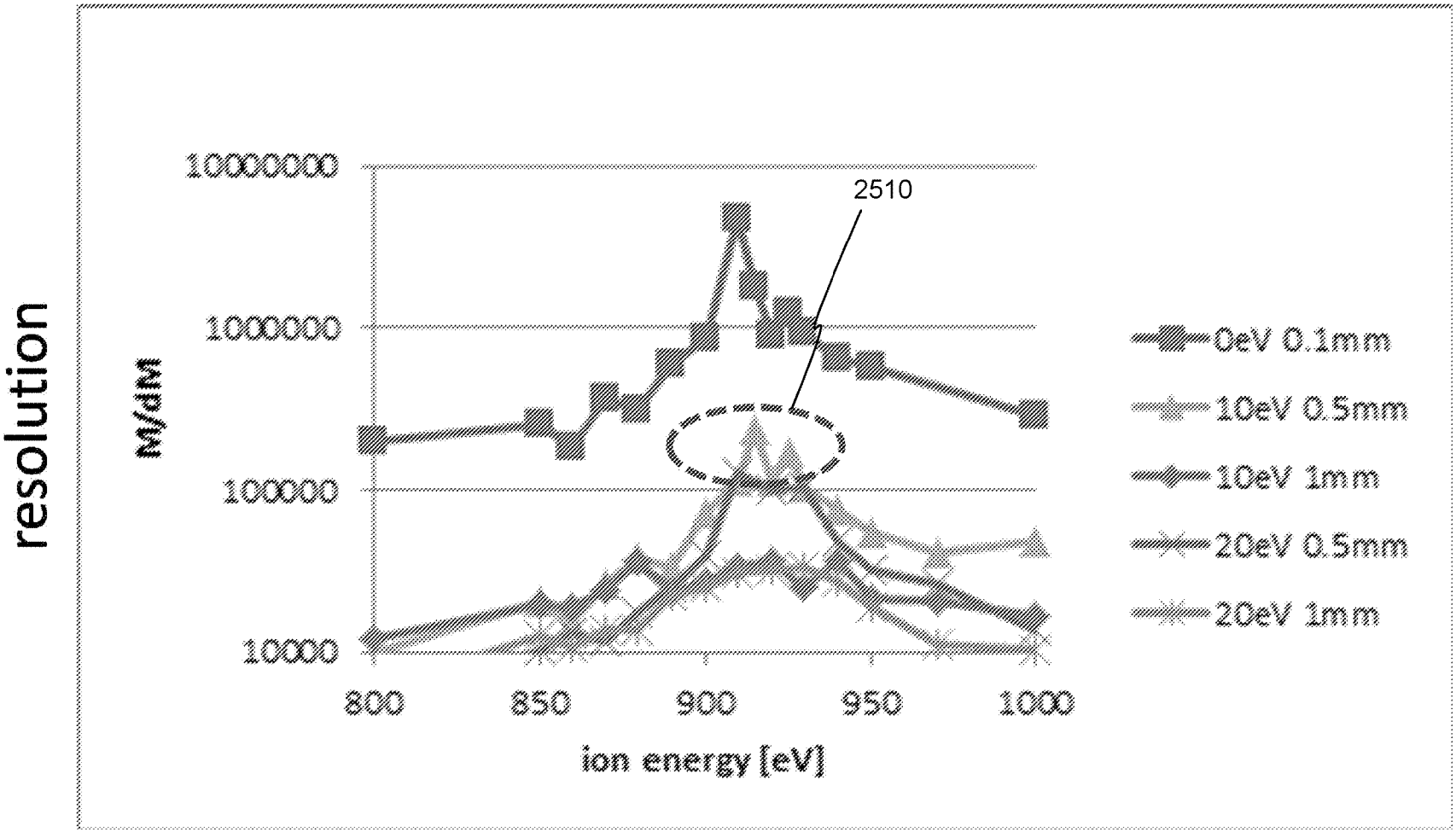
FIG. 25 is an exemplary plot of simulated measurements of resolution versus ion energy from the ELIT of FIG. 12 for a number of different ion beam energies and radii, in accordance with various embodiments.

FIG. 25 is an exemplary plot 2500 of simulated measurements of resolution versus ion energy from the ELIT of FIG. 12 for a number of different ion beam energies and radii, in accordance with various embodiments. Region 2510 shows that the ELIT of FIG. 12 is able to produce a resolution of greater that 100,000 when the ion beam energy is 10 eV and the ion beam radius is 0.5 mm. In other words, FIG. 25 shows that the ELIT of FIG. 12 can be used as a practical device.

Figure 26:
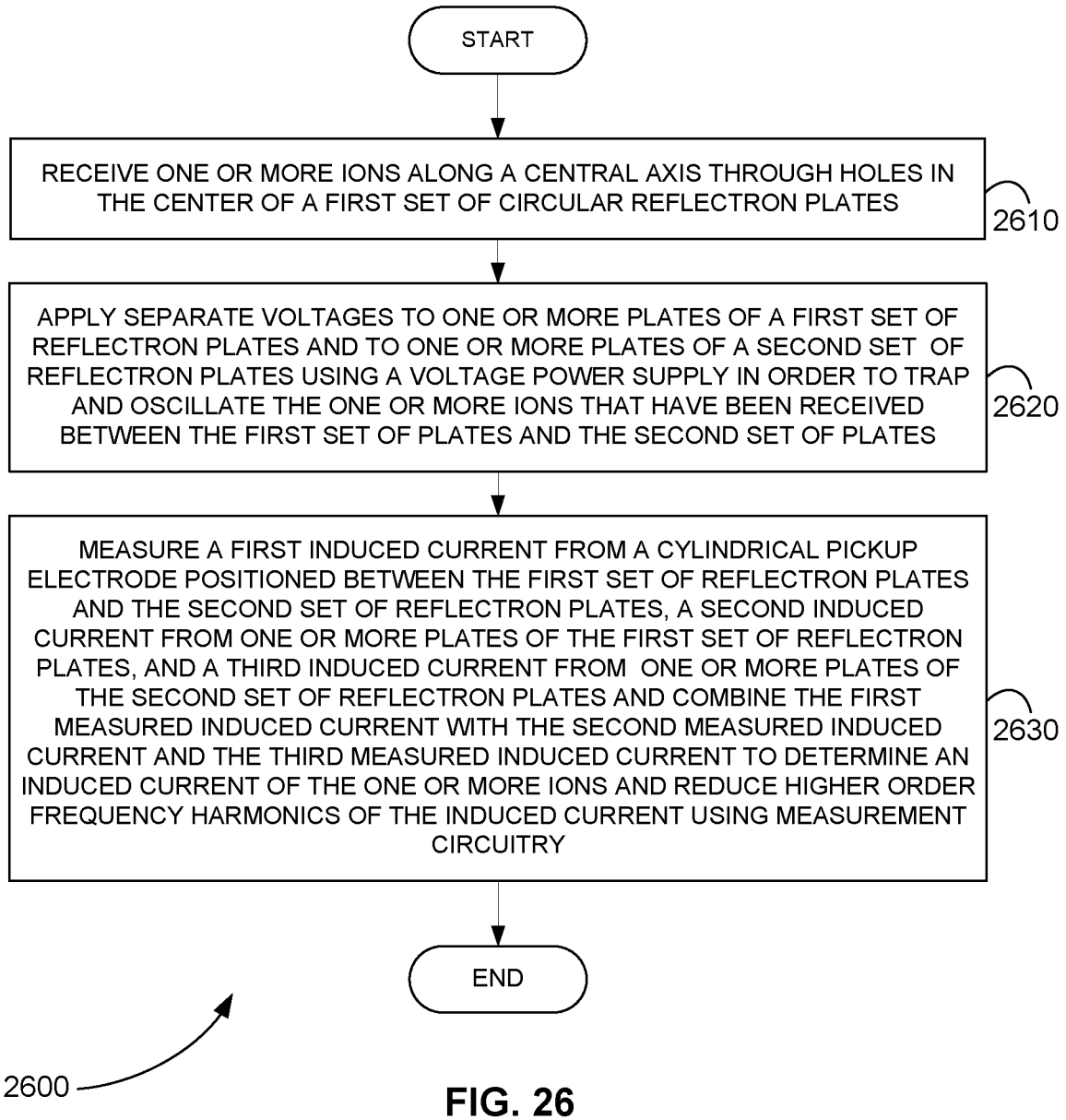
FIG. 26 is a flowchart showing a method for measuring the induced current of one or more ions in an electrostatic linear ion trap and reducing higher order frequency harmonics of the induced current by combining the induced current with measurements from reflecting reflectron plates, in accordance with various embodiments.

Method for Reducing Higher Order Harmonics in an ELIT by Adding Measurements from Reflecting Plates FIG. 26 is a flowchart showing a method 2600 for measuring the induced current of one or more ions in an electrostatic linear ion trap and reducing higher order frequency harmonics of the induced current by combining the induced current with measurements from reflecting reflectron plates, in accordance with various embodiments.

In step 2610 of method 2600, one or more ions are received along a central axis through holes in the center of a first set of reflectron plates. The plates of the first set of plates are coaxially aligned along the central axis. The first set of plates includes a first inlet plate followed by a first plurality of reflection plates followed by a first plurality of trapping plates.

A cylindrical pickup electrode is positioned so that a first end of the pickup electrode is adjacent to the first inlet plate of the first set of plates. The pickup electrode is coaxially aligned with the first set of plates along the central axis.

A second set of reflectron plates with holes in the center are coaxially aligned with the pickup electrode along the central axis. The second set of plates includes a second inlet plate followed by a second plurality of reflection plates followed by a second plurality of trapping plates. The second set of plates is positioned so that the second inlet plate is adjacent to a second end of the cylindrical pickup electrode.

In step 2620, separate voltages are applied to one or more plates of the first set of plates and to one or more plates of the second set of plates using a voltage power supply. These voltages are applied in order to trap and oscillate the one or more ions that have been received between the first set of plates and the second set of plates.

In step 2630, a first induced current is measured from the cylindrical pickup electrode, a second induced current is measured from one or more plates of the first set of reflectron plates, and a third induced current is measured from one or more plates of the second set of reflection plates using measurement circuitry. Further, the first measured induced current is combined with the second measured induced current and the third measured induced current to determine an induced current of the one or more ions and reduce higher order frequency harmonics of the induced current using the measurement circuitry.

In various embodiments, the one or more plates of the first set of reflectron plates include the first inlet plate and one or more plates of the first plurality of reflection plates and the one or more plates of the second set of reflectron plates include the second inlet plate and one or more plates of the second plurality of reflection plates.

In various embodiments, combining the first measured induced current with the second measured induced current and the third measured induced current includes summing the second measured induced current, the third measured induced current, and twice the first measured induced current.

ELIT for Reducing Higher Order Harmonics by Subtracting Measurements from Trapping Plates Common-mode or environmental signals are induced along the signal path of a conventional Fourier transform ELIT from sources such as radiofrequency power supplies, mains voltage, turbomolecular pumps, etc. These noise sources generate peaks in the mass spectrum after Fourier transformation which do not result from the detection of an ion. Existing experimental detection schemes for a conventional electrostatic linear ion trap rely upon non-differential detection using a central pickup electrode.

In various embodiments, a technique is disclosed for differentially detecting the image current of an ion within an ELIT using an operational amplifier, thereby minimizing common-mode signals and false peaks in the mass spectrum. By utilizing detection electrodes near the ion turning point, or trapping electrodes in the reflectron, a nearly sinusoidal signal is preserved, thereby minimizing peaks corresponding to harmonic frequencies and simplifying data processing.

Figure 27:
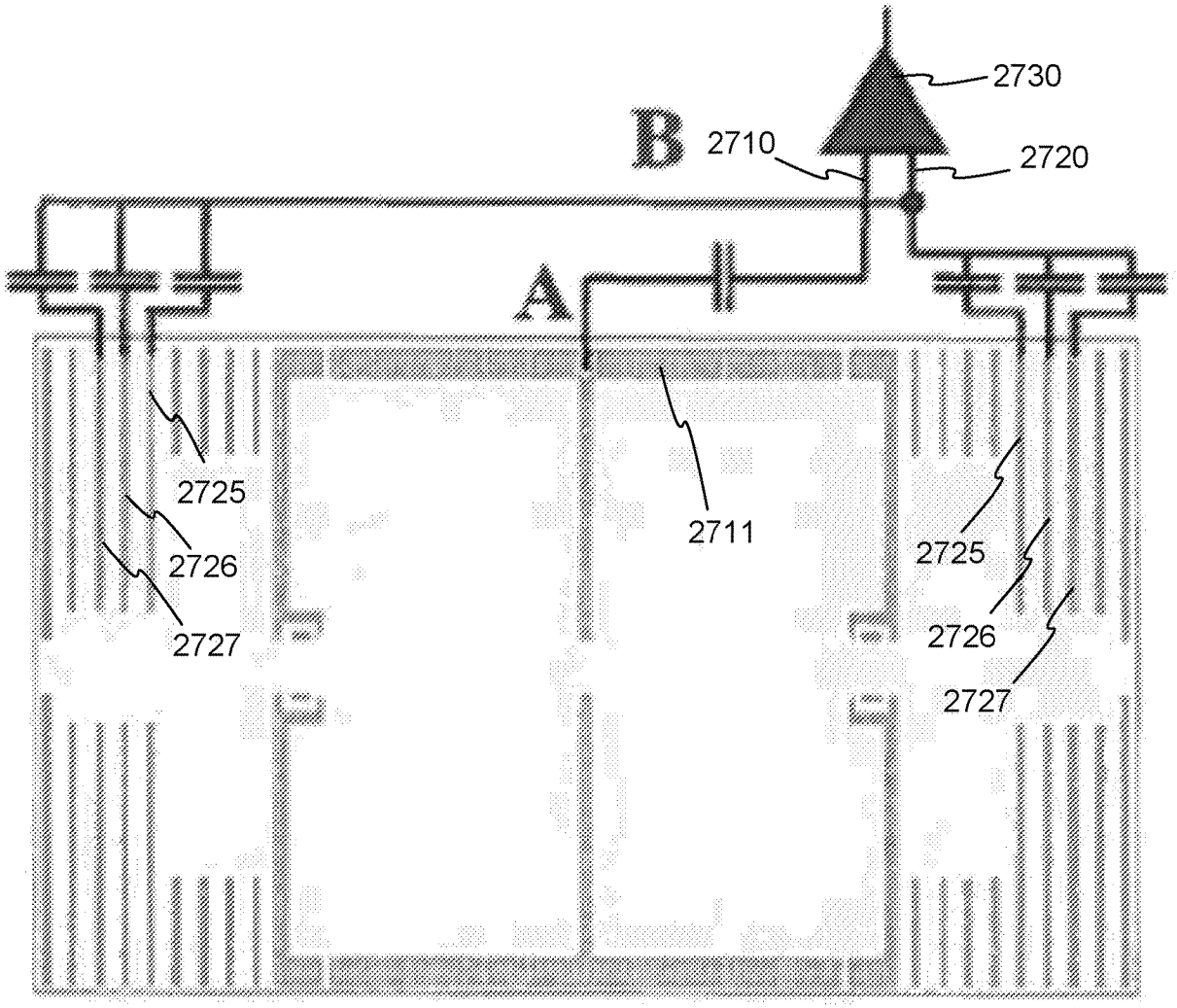
FIG. 27 is a two-dimensional cross-sectional view of an ELIT for measuring induced current of one or more ions and reducing higher order frequency harmonics of the induced current by combining the induced current with measurements from trapping reflectron plates, in accordance with various embodiments.

FIG. 27 is a two-dimensional cross-sectional view 2700 of an ELIT for measuring induced current of one or more ions and reducing higher order frequency harmonics of the induced current by combining the induced current with measurements from trapping reflectron plates, in accordance with various embodiments. The ELIT geometry utilized is similar to the geometry of FIG. 12. The induced current is monitored in two places along the axis of the ELIT. Central electrode 2711 is capacitively coupled to input 2710 (A) of differential transimpedance operational amplifier 2730. Trapping reflectron plates 2725, 2726, and 2727 on both side of the ELIT are capacitively coupled to input 2720 (B) of differential amplifier 2730. By utilizing the trapping reflectron plates to measure the induced current, a signal is still detected while the ion is turning around.

The measured induced image current out of differential amplifier 2730 is the difference between the two inputs, i.e., A-B, which is Fourier transformed and calibrated to generate a mass spectrum. The magnitude of the induced current (>200 f A/charge at m/z 525) is virtually identical to the induced current measured from FIG. 12, as described above, thereby preserving the signal integrity. In FIG. 12, the induced current measured is the sum of twice the current measured from the central electrodes (2A1) and the current measured from the inlet plate and three of reflecting reflectron plates on both sides of the ELIT (A2), or the sum 2A1+A2.

The detected noise of the measurement technique of FIG. 27 is reduced by a factor of sqrt(5/2) relative to the (2A1+A2) detection scheme of FIG. 12, increasing the signal-to-noise of the measurement by the same factor. This minimizes the number of charges that need to be injected and thereby reduces adverse effects that could arise from space charge (e.g., peak splitting, frequency drifts, coalescence).

In Fourier transform mass spectrometry, differential detection minimizes common-mode signals from environmental sources (e.g., mains voltage, RF pickup, or pumps). Additionally, by using the trapping reflectron electrodes near the ion turning points as detectors, nearly sinusoidal signals are observed, minimizing harmonic content and false peaks. This also allows for standard FFT processing which can easily display the derived mass spectrum in real-time and allows the user to know exactly how the mass spectrum is generated (software transparency). In summary, differential detection lowers the noise floor of the induced image charge measurement, reduces the number of charges that need to be injected, reduces space charge effects, reduces common-mode noise, provides a real-time mass spectrum, and generates a mass spectrum of higher integrity.

Figure 28:
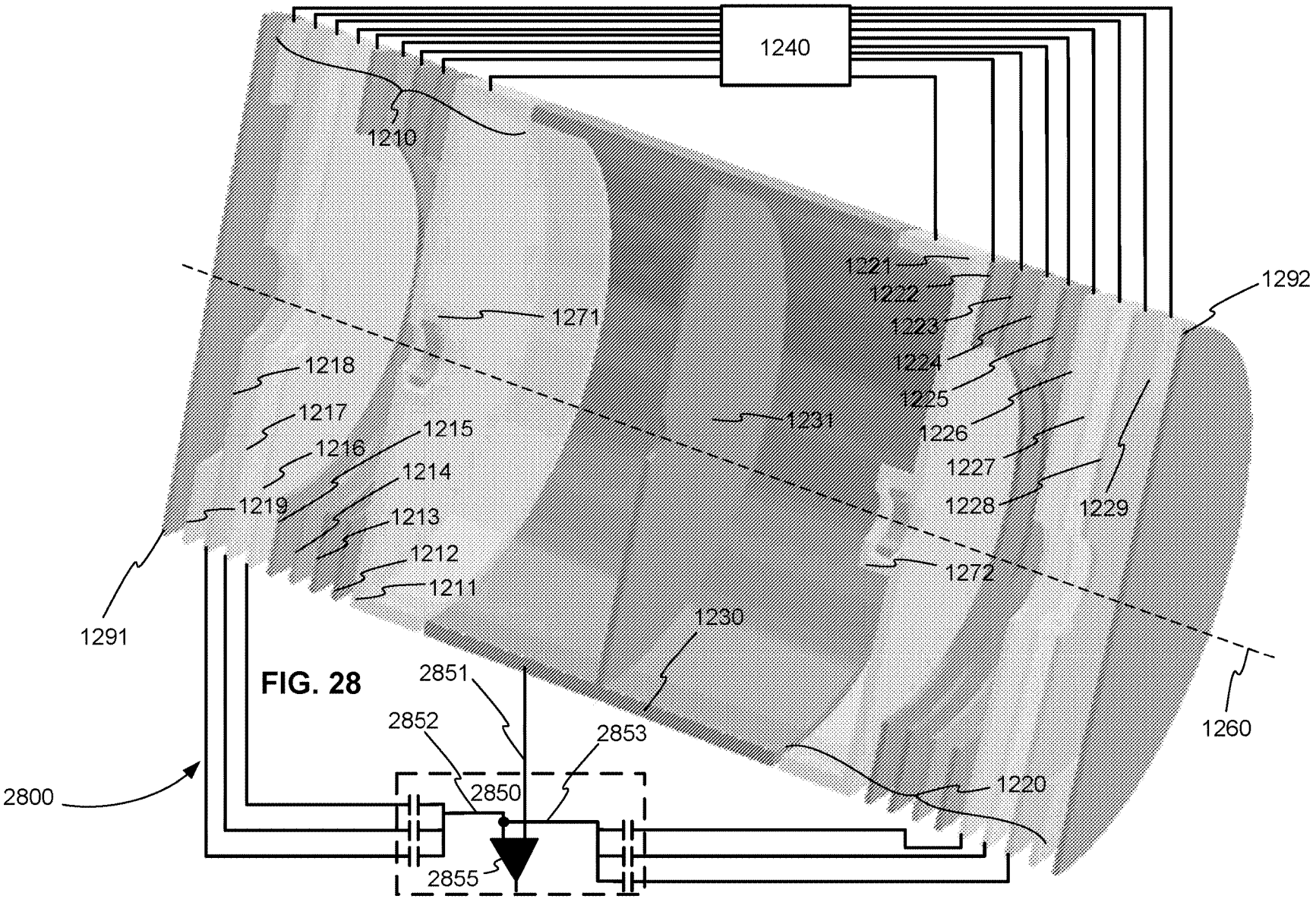
FIG. 28 is a three-dimensional cutaway side view of an ELIT for measuring induced current of one or more ions and reducing higher order frequency harmonics of the induced current by combining the induced current with measurements from trapping reflectron plates, in accordance with various embodiments.

FIG. 28 is a three-dimensional cutaway side view 2800 of an ELIT for measuring induced current of one or more ions and reducing higher order frequency harmonics of the induced current by combining the induced current with measurements from trapping reflectron plates, in accordance with various embodiments. Like the ELIT of FIG. 12, the ELIT of FIG. 28 includes first set of reflectron plates 1210, cylindrical pickup electrode 1230, second set of reflectron plates 1220, voltage power supply 1240, and measurement circuitry 2850.

The plates of first set of reflectron plates 1210 each includes holes in the center and are coaxially aligned along central axis 1260. First set of plates 1210 includes first inlet plate 1211 followed by a first plurality of reflection plates and, in turn, followed by a first plurality of trapping plates. The first plurality of reflection plates include plates 1212, 1213, 1214, and 1215. The first plurality of trapping plates include plates 1216, 1217, 1218, and 1219. Plate 1291 is not part of the ELIT and is only used for simulation purposes.

Cylindrical pickup electrode 1230 is positioned so that a first end of pickup electrode 1230 is adjacent to first inlet plate 1211 of first set of plates 1210 and pickup electrode 1230 is coaxially aligned with first set of plates 1210 along central axis 1260.

The plates of second set of reflectron plates 1220 also each includes holes in the center and are coaxially aligned along central axis 1260. Second set of plates 1220 includes second inlet plate 1221 followed by a second plurality of reflection plates and, in turn, followed by a second plurality of trapping plates. The second plurality of reflection plates include plates 1222, 1223, 1224, and 1225. The second plurality of trapping plates include plates 1226, 1227, 1228, and 1229. Plate 1292 is not part of the ELIT and is only used for simulation purposes. Second set of plates 1220 is positioned so that second inlet plate 1221 is adjacent to a second end of cylindrical pickup electrode 1230.

Voltage power supply 1240 applies pulsed voltages to one or more plates of first set of plates 1210 and one or more plates of second set of plates 1220 are held at their static trapping potentials. In this manner, the accepted m/z range of the device is extended. In this case, voltage power supply 1240 applies separate voltages to nine plates of first set of trapping plates 1210 and to nine plates of second set of plates 1220. Inlet plates 1211 and 1221 can have a zero voltage, for example. These voltages are applied in order to trap and then oscillate one or more ions between first set of plates 1210 and second set of plates 1220. The one or more ions have been received along central axis 1260 through the holes of first set of plates 1210, for example.

Voltage power supply 1240 can be one power supply with multiple outputs that can supply multiple different voltages as shown in FIG. 12. In various other embodiments, voltage power supply 1240 can be two or more separate power supplies.

Measurement circuitry 2850 is used to measure first induced current 2851 from cylindrical pickup electrode 1230, second induced current 2852 from one or more plates of the first set of reflectron plates, and third induced current 2853 from one or more plates of the second set of reflectron plates. Measurement circuitry 2850 combines first measured induced current 2851 with second measured induced current 2852 and third measured induced current 2853 to determine an induced current of the one or more ions. The use of second measured induced current 2852 and third measured induced current 2853 in addition to first measured induced current 2851 reduces higher order frequency harmonics of the induced current.

In various embodiments, one or more plates of first set of reflectron plates 1210 include one or more plates (1216, 1217, and 1218) of the first plurality of trapping plates and one or more plates of second set of reflectron plates 1220 include one or more plates (1226, 1227, and 1228) of the second plurality of trapping plates.

In various embodiments, measurement circuitry 2850 combines first measured induced current 2851 with second measured induced current 2852 and third measured induced current 2853 by subtracting second measured induced current 2852 and third measured induced current 2853 from first measured induced current 2851.

In various embodiments, measurement circuitry 2850 includes differential transimpedance amplifier 2855. Cylindrical pickup electrode 1230 is capacitively coupled to a first input of differential transimpedance amplifier 2855 and the one or more plates (1216, 1217, and 1218) of the first plurality of trapping plates and the one or more plates (1226, 1227, and 1228) of the second plurality of trapping plates are each capacitively coupled to a second input of differential transimpedance amplifier 2855 to perform the subtraction.

Figure 29:
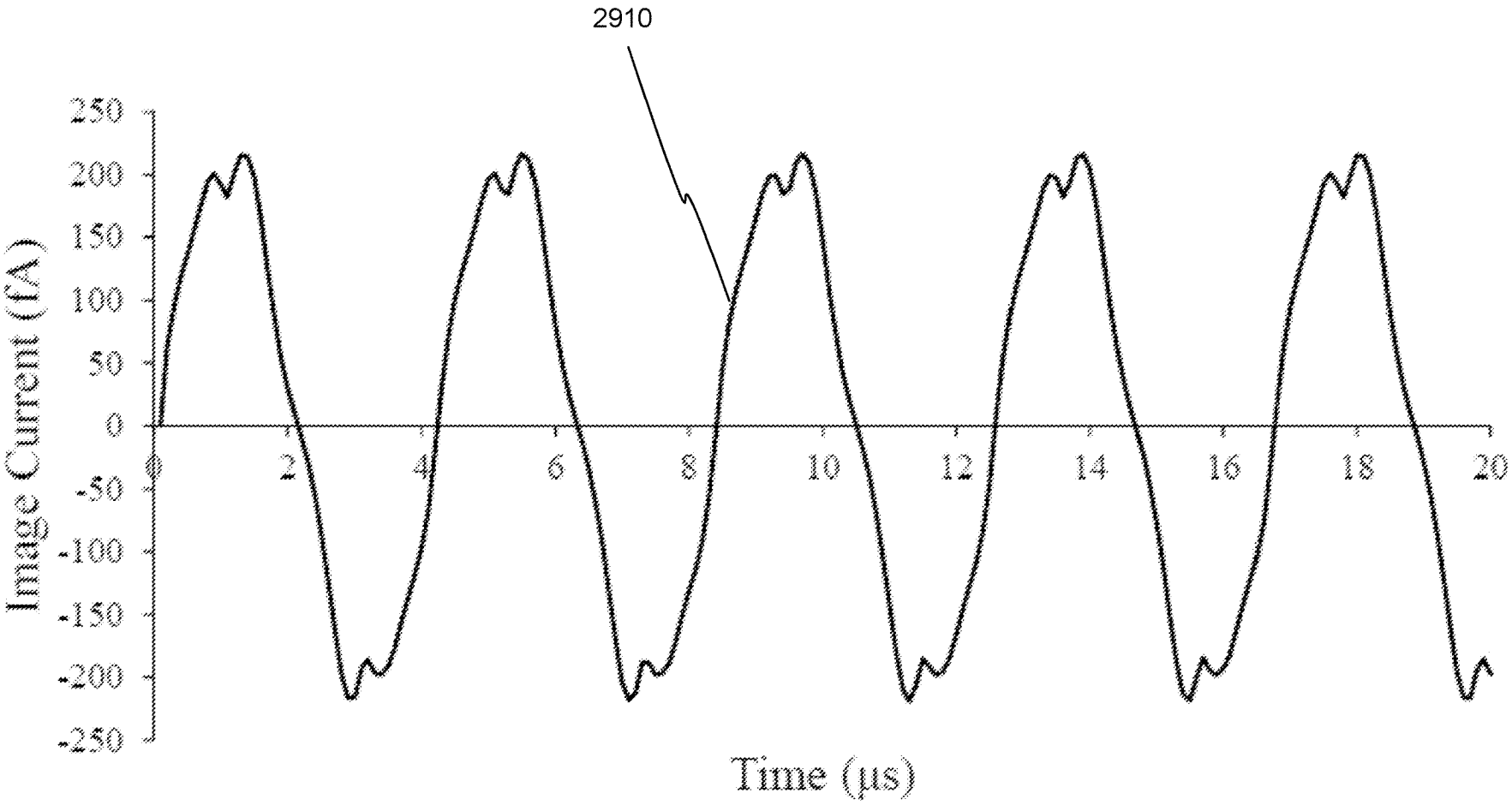
FIG. 29 is an exemplary plot showing the combined induced current measured by the ELIT of FIG. 28 by subtracting the second measured induced current and the third measured induced current from the first measured induced current of FIG. 28, in accordance with various embodiments.

FIG. 29 is an exemplary plot 2900 showing the combined induced current 2910 measured by the ELIT of FIG. 28 by subtracting second measured induced current 2852 and third measured induced current 2853 from first measured induced current 2851 of FIG. 28, in accordance with various embodiments.

A comparison of combined induced current 2910 of FIG. 29 with induced current 2110 of FIG. 21 shows that the ELIT of FIG. 29 can also produce an induced current measurement that is more sinusoidal in shape.

Figure 30:
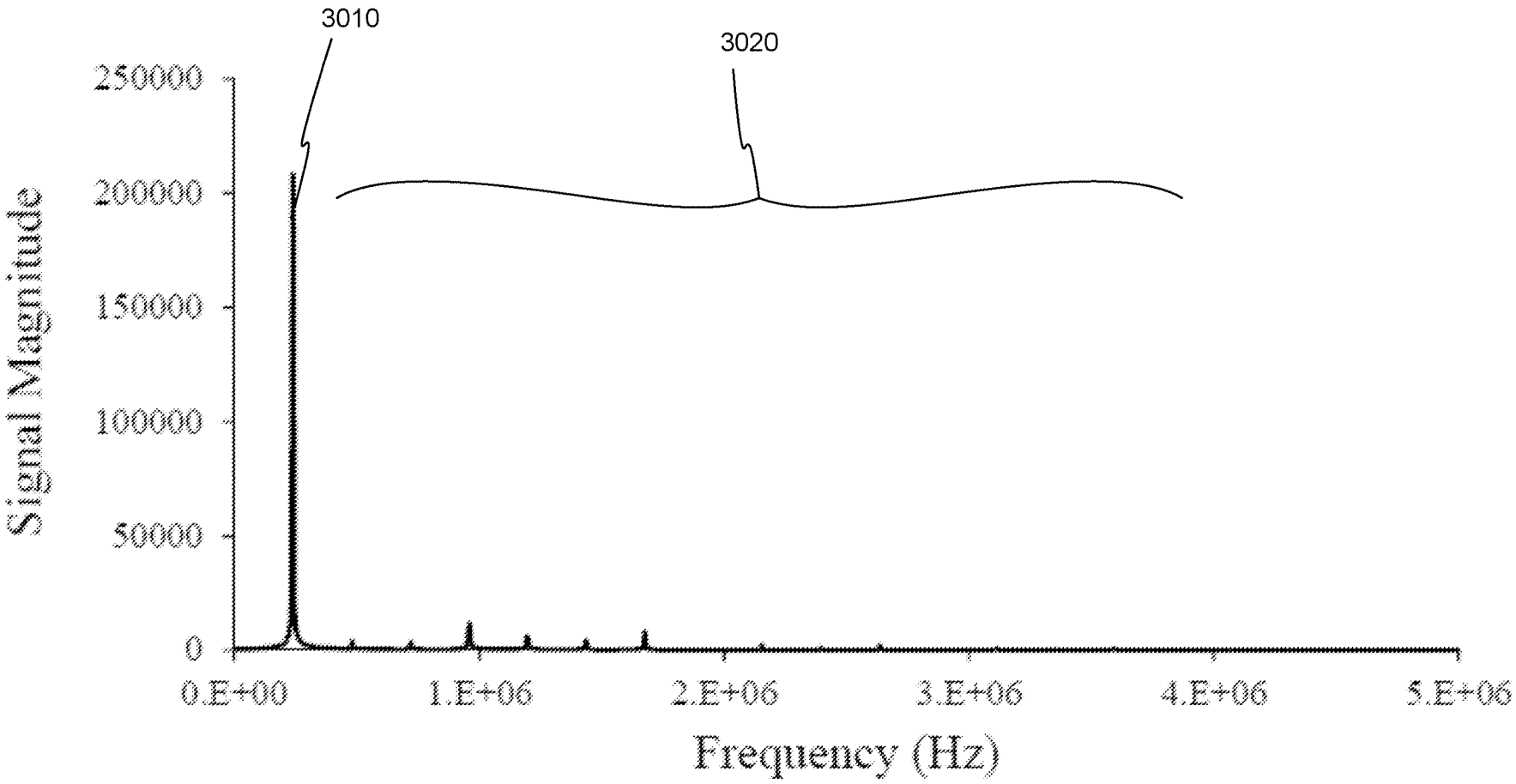
FIG. 30 is an exemplary plot showing the fundamental frequency and higher order harmonics obtained by applying a Fourier transform to the measured induced current of FIG. 29, in accordance with various embodiments.

FIG. 30 is an exemplary plot 3000 showing the fundamental frequency and higher order harmonics obtained by applying a Fourier transform to the measured induced current of FIG. 29, in accordance with various embodiments. Plot 3000 includes fundamental frequency 3010 and higher order harmonics 3020.

Figure 31:
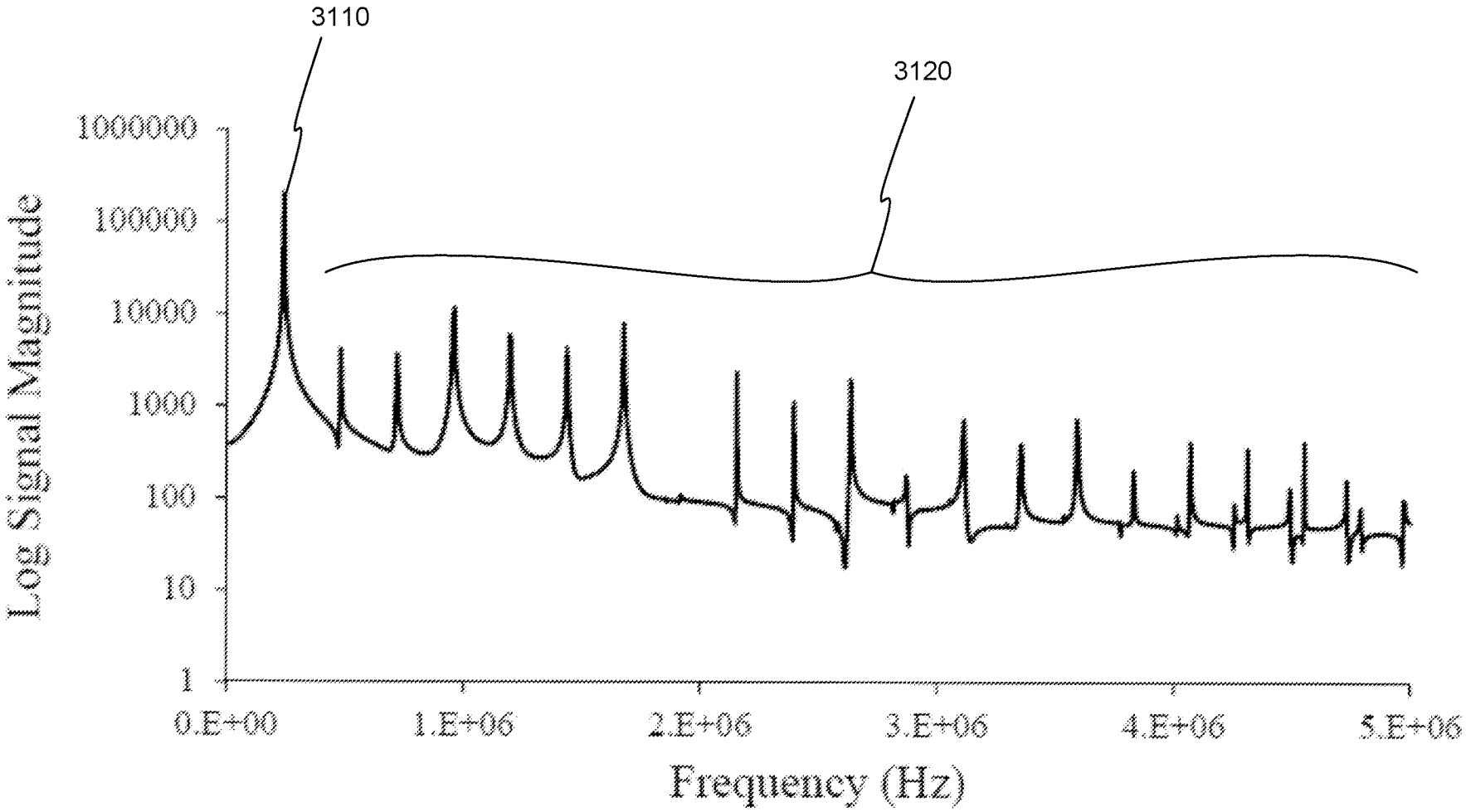
FIG. 31 is an exemplary plot showing the fundamental frequency and higher order harmonics obtained by applying a Fourier transform to the measured induced current of FIG. 29 with their amplitudes plotted on a logarithmic scale, in accordance with various embodiments.

FIG. 31 is an exemplary plot 3100 showing the fundamental frequency and higher order harmonics obtained by applying a Fourier transform to the measured induced current of FIG. 29 with their amplitudes plotted on a logarithmic scale, in accordance with various embodiments. Plot 3100 includes fundamental frequency 3110 and higher order harmonics 3120. Both FIGS. 30 and 31 show that the ELIT of FIG. 28 is able to reduce higher order harmonics relative to the fundamental frequency.

Method for Reducing Higher Order Harmonics in an ELIT by Adding Measurements from Trapping Plates Returning to FIG. 26, in step 2630, a first induced current is measured from the cylindrical pickup electrode, a second induced current is measured from one or more plates of the first set of reflectron plates, and a third induced current is measured from one or more plates of the second set of reflectron plates using measurement circuitry. Further, the first measured induced current is combined with the second measured induced current and the third measured induced current to determine an induced current of the one or more ions and reduce higher order frequency harmonics of the induced current using the measurement circuitry.

In various embodiments, the one or more plates of the first set of reflectron plates include one or more plates of the first plurality of trapping plates and the one or more plates of the second set of reflectron plates include one or more plates of the second plurality of trapping plates.

In various embodiments, combining the first measured induced current with the second measured induced current and the third measured induced current includes subtracting the second measured induced current and the third measured induced current from the first measured induced current.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. An electrostatic linear ion trap for measuring induced current of one or more ions and reducing higher order frequency harmonics of the induced current by combining the induced current with measurements from reflecting reflectron plates, comprising:

a first set of reflectron plates with holes in the center that are coaxially aligned along a central axis, wherein the first set of plates includes a first inlet plate followed by a first plurality of reflection plates followed by a first plurality of trapping plates;

a cylindrical pickup electrode positioned so that a first end of the pickup electrode is adjacent to the first inlet plate of the first set of plates and the pickup electrode is coaxially aligned with the first set of plates along the central axis;

a second set of reflectron plates with holes in the center that are coaxially aligned with the pickup electrode along the central axis, wherein the second set of plates includes a second inlet plate followed by a second plurality of reflection plates followed by a second plurality of trapping plates and wherein the second set of plates is positioned so that the second inlet plate is adjacent to a second end of the cylindrical pickup electrode;

a voltage power supply for applying separate voltages to one or more plates of the first set of reflectron plates and to one or more plates of the second set of reflectron plates in order to trap and oscillate one or more ions that have been received along the central axis through the holes of the first set of plates between the first set of plates and the second set of plates; and measurement circuitry to measure a first induced current from the cylindrical pickup electrode, a second induced current from one or more plates of the first set of reflectron plates, and a third induced current from one or more plates of the second set of reflectron plates and to combine the first measured induced current with the second measured induced current and the third measured induced current to determine an induced current of the one or more ions and reduce higher order frequency harmonics of the induced current.

2. The electrostatic linear ion trap of claim 1, wherein the one or more plates of the first set of reflectron plates include the first inlet plate and one or more plates of the first plurality of reflection plates and wherein the one or more plates of the second set of reflectron plates include the second inlet plate and one or more plates of the second plurality of reflection plates.

3. The electrostatic linear ion trap of claim 2, wherein the measurement circuitry combines the first measured induced current with the second measured induced current and the third measured induced current by summing the second measured induced current, the third measured induced current, and twice the first measured induced current.

4. The electrostatic linear ion trap of claim 3, wherein the second measured induced current and the third measured induced current are adjusted to have the same phase before the second measured induced current and the third measured induced current are summed with twice the first measured induced current.

5. The electrostatic linear ion trap of claim 1, wherein the one or more plates of the first set of reflectron plates include one or more plates of the first plurality of trapping plates and wherein the one or more plates of the second set of reflectron plates include one or more plates of the second plurality of trapping plates.

6. The electrostatic linear ion trap of claim 5, wherein the measurement circuitry combines the first measured induced current with the second measured induced current and the third measured induced current by subtracting the second measured induced current and the third measured induced current from the first measured induced current.

7. The electrostatic linear ion trap of claim 6, wherein the measurement circuitry comprises a differential transimpedance amplifier and wherein the cylindrical pickup electrode is capacitively coupled to a first input of the differential transimpedance amplifier and the one or more plates of the first plurality of trapping plates and the one or more plates of the second plurality of trapping plates are each capacitively coupled to a second input of the differential transimpedance amplifier to perform the subtraction.

8. The electrostatic linear ion trap of claim 1, wherein the cylindrical pickup electrode includes a circular plate in the middle of the cylindrical pickup electrode and the circular plate has a hole in the center.

9. The electrostatic linear ion trap of claim 1, wherein the diameter of the cylindrical pickup electrode is half the length of the distance between the first set of plates and the second set of plates.

10. The electrostatic linear ion trap of claim 1, wherein the hole diameter of the one or more plates of the first plurality of reflection plates is larger than the hole diameter of the other plates of the first set of plates, and the hole diameter of the one or more plates of the second plurality of reflection plates is larger than the hole diameter of the other plates of the second set of plates.

11. The electrostatic linear ion trap of claim 1, wherein the first inlet plate further includes a first focusing lens around the hole of the first inlet plate to focus the one or more ions radially and wherein the second inlet plate further includes a second focusing lens around the hole of the second inlet plate to focus the one or more ions radially.

12. The electrostatic linear ion trap of claim 1, wherein the electrostatic linear ion trap further includes processing circuitry that receives the induced current from the measurement circuitry, performs a Fourier transform on the induced current to determine one or more oscillation frequencies of the one or more ions, and calculates mass-to-charge ratios of the one or more ions from the one or more oscillation frequencies.

13. A method for measuring the induced current of one or more ions in an electrostatic linear ion trap and reducing higher order frequency harmonics of the induced current by combining the induced current with measurements from reflecting reflectron plates, comprising:

receiving one or more ions along a central axis through holes in the center of a first set of reflectron plates, wherein the first set of plates are coaxially aligned along the central axis and the first set of plates includes a first inlet plate followed by a first plurality of reflection plates followed by a first plurality of trapping plates, wherein a cylindrical pickup electrode is positioned so that a first end of the pickup electrode is adjacent to the first inlet plate of the first set of plates and the pickup electrode is coaxially aligned with the first set of plates along the central axis, and wherein a second set of reflectron plates with holes in the center are coaxially aligned with the pickup electrode along the central axis, the second set of plates includes a second inlet plate followed by a second plurality of reflection plates followed by a second plurality of trapping plates, and the second set of plates is positioned so that the second inlet plate is adjacent to a second end of the cylindrical pickup electrode;

applying voltages to one or more plates of the first set of plates and to one or more plates of the second set of plates using a voltage power supply in order to trap and oscillate the one or more ions that have been received between the first set of plates and the second set of plates; and measuring a first induced current from the cylindrical pickup electrode, a second induced current from one or more plates of the first set of reflectron plates, and a third induced current from one or more plates of the second set of reflectron plates and combining the first measured induced current with the second measured induced current and the third measured induced current to determine an induced current of the one or more ions and reduce higher order frequency harmonics of the induced current using measurement circuitry.

14. The method of claim 13, wherein the one or more plates of the first set of reflectron plates include the first inlet plate and one or more plates of the first plurality of reflection plates and wherein the one or more plates of the second set of reflectron plates include the second inlet plate and one or more plates of the second plurality of reflection plates.

15. The method of claim 14, wherein combining the first measured induced current with the second measured induced current and the third measured induced current comprises summing the second measured induced current, the third measured induced current, and twice the first measured induced current.

16. The method of claim 13, wherein the one or more plates of the first set of reflectron plates include one or more plates of the first plurality of trapping plates and wherein the one or more plates of the second set of reflectron plates include one or more plates of the second plurality of trapping plates.

17. The method of claim 16, wherein combining the first measured induced current with the second measured induced current and the third measured induced current comprises subtracting the second measured induced current and the third measured induced current from the first measured induced current.

* * * * *